US012607082B2

(12) United States Patent
Cheng et al.

(10) Patent No.: US 12,607,082 B2
(45) Date of Patent: Apr. 21, 2026

(54) BI-DIRECTIONAL WELLHEAD ANNULUS PACKOFF WITH INTEGRAL SEAL AND HANGER LOCKDOWN RING

(71) Applicant: Baker Hughes Oilfield Operations LLC, Houston, TX (US)

(72) Inventors: Samuel Cheng, Houston, TX (US); Xichang Zhang, Houston, TX (US); Prashant Patel, Tomball, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 127 days.

(21) Appl. No.: 18/512,909

(22) Filed: Nov. 17, 2023

(65) Prior Publication Data

US 2024/0084662 A1 Mar. 14, 2024

Related U.S. Application Data

(62) Division of application No. 17/523,699, filed on Nov. 10, 2021, now Pat. No. 11,851,972.

(51) Int. Cl.

| | |
|---|---|
| ***E21B 33/04*** | (2006.01) |
| ***E21B 23/02*** | (2006.01) |
| ***E21B 33/12*** | (2006.01) |

(52) U.S. Cl.

CPC ..... *E21B 33/04* (2013.01); *E21B 23/02* (2013.01); *E21B 33/12* (2013.01); *E21B 2200/01* (2020.05)

(58) Field of Classification Search

CPC ..... E21B 23/00; E21B 19/16; E21B 17/06; E21B 33/04

See application file for complete search history.

(56) References Cited

U.S. PATENT DOCUMENTS

| | | | |
|---|---|---|---|
| 4,674,576 | A | 6/1987 | Goris |
| 4,736,799 | A | 4/1988 | Ahlstone |
| 4,834,175 | A | 5/1989 | Ross |
| 5,069,288 | A | 12/1991 | Singeetham |

(Continued)

FOREIGN PATENT DOCUMENTS

| | | |
|---|---|---|
| CN | 112377138 | 2/2021 |
| WO | 2017/035545 | 3/2017 |

OTHER PUBLICATIONS

"Seal Qualification and Single-Trip Lockdown Sleeve Reduce Risk," Journal of Petroleum Technology, Sep. 30, 2020, 6 pages.

(Continued)

*Primary Examiner* — Catherine Loikith

(74) *Attorney, Agent, or Firm* — Hogan Lovells US LLP

(57) ABSTRACT

A wellhead annulus packoff and an associated method of energizing and de-energizing include at least one seal element, a hanger lockdown ring, a hanger lockdown energizing ring, a seal lockdown ring, a seal lockdown energizing ring, and one or more mechanical conditional operators, where the at least one seal element adapted to be energized with a first energizing force applied through a seal lockdown energizing ring and with the one or more mechanical conditional operators being engaged, where the seal lockdown ring is adapted to be energized with the first energizing force and with the one or more mechanical conditional operators being disengaged, and where the hanger lockdown ring is adapted to be energized with a second energizing force applied through a hanger lockdown energizing ring.

20 Claims, 15 Drawing Sheets

(56) References Cited

U.S. PATENT DOCUMENTS

| | | | | |
|---|---|---|---|---|
| 5,174,376 | A | 12/1992 | Singeetham | |
| 8,146,670 | B2 | 4/2012 | Ellis | |
| 8,500,127 | B2 | 8/2013 | Gette | |
| 8,851,183 | B2 * | 10/2014 | Yates | E21B 33/043 166/368 |
| 8,978,772 | B2 | 3/2015 | Yates | |
| 9,388,655 | B2 * | 7/2016 | Sommerfeld | E21B 33/03 |
| 9,939,089 | B2 | 4/2018 | Baca | |
| 9,982,502 | B2 | 5/2018 | Nelson | |
| 10,100,595 | B2 * | 10/2018 | Nguyen | E21B 33/04 |
| 10,196,872 | B2 | 2/2019 | Kauffmann | |
| 11,649,689 | B1 * | 5/2023 | Cheng | F16J 15/189 166/387 |
| 12,276,170 | B2 * | 4/2025 | Beaver | E21B 41/02 |
| 2016/0245040 | A1 | 8/2016 | Nelson | |
| 2016/0265298 | A1 | 9/2016 | Nguyen | |
| 2021/0062603 | A1 | 3/2021 | Cheng | |

OTHER PUBLICATIONS

Dril-Quip, Inc., "SS-20 BigBore Subsea Wellhead Systems," 2015, 14 pages.

International Search Report and Written Opinion mailed Mar. 2, 2023 in corresponding PCT Application No. PCT/US2022/079214.

* cited by examiner

BI-DIRECTIONAL WELLHEAD ANNULUS PACKOFF WITH INTEGRAL SEAL AND HANGER LOCKDOWN RING

CROSS-REFERENCE TO RELATED APPLICATIONS

This application is a divisional of U.S. patent application Ser. No. 17/523,699, titled "BI-DIRECTIONAL WELLHEAD ANNULUS PACKOFF WITH INTEGRAL SEAL AND HANGER LOCKDOWN RING," filed Nov. 10, 2021, and granted as U.S. Pat. No. 11,851,972, on Dec. 26, 2023, which is incorporated by reference herein in its entirety for all intents and purposes.

BACKGROUND

1. Field of Invention

This disclosure relates generally to oilfield equipment and more particularly to a bi-directional wellhead annulus packoff and an associated method for energizing and de-energizing the wellhead annulus packoff.

2. Description of the Prior Art

Hangers may be configured with an external lockdown ring that is located above or below a wellhead annulus packoff. The wellhead annulus packoff can be locked down below the wellhead annulus packoff. However, such a configuration may create a debris pocket for accumulation of matter therein. A debris pocket can impede an ability of the lockdown ring to engage in a housing or hanger. Further, hangers may be configured with an external lockdown ring above the wellhead annulus packoff with some advantages, such as to allow for a debris pocket below the wellhead annulus packoff to accommodate debris. This, however, transfers a hanger lockdown load through the wellhead annulus packoff, which can cause issues for seal components in the wellhead annulus packoff. The wellhead annulus packoff can be locked independently to a neck of the hanger to prevent shuttling relative to the hanger. The timing and mechanism may be an issue while setting the wellhead annulus packoff, and particularly setting a seal lockdown ring and a hanger lockdown ring, in an annular envelop between the hanger neck and a wellhead housing bore.

SUMMARY

In at least one embodiment, a method to be used for energizing a wellhead annulus packoff is disclosed. The method includes providing at least one seal element, a seal lockdown energizing ring, a hanger lockdown energizing ring, a seal lockdown ring, and a hanger lockdown ring as seal components for the wellhead annulus packoff. The method also includes providing one or more mechanical conditional operators adapted to disengage during energizing of the wellhead annulus packoff. A further feature of the method includes enabling a first energizing force to cause, through the seal lockdown energizing ring, the at least one seal element and the seal lockdown ring to be energized. The method also includes enabling a second energizing force to cause, through the hanger lockdown energizing ring, the hanger lockdown ring to be energized.

In at least one embodiment, a further method to be used for de-energizing a wellhead annulus packoff is disclosed. The method is applied to the wellhead annulus packoff that includes at least one seal element, a seal lockdown energizing ring, a hanger lockdown energizing ring, a seal lockdown ring, a hanger lockdown ring, and one or more mechanical conditional operators in a disengaged state with the wellhead annulus packoff in a fully energized stage. The method includes enabling a first de-energizing force through the hanger lockdown energizing ring. The first de-energizing force is to cause the hanger lockdown ring to be de-energized. A further step in the method is for enabling a second de-energizing force through the seal lockdown energizing ring. The second de-energizing force is to cause the at least one seal element and the seal lockdown ring to be de-energized.

In at least one embodiment, a wellhead annulus packoff is disclosed. The wellhead annulus packoff includes at least one seal element, a hanger lockdown ring, a seal lockdown ring, and one or more mechanical conditional operators, where the at least one seal element adapted to be energized with a first energizing force and with the one or more mechanical conditional operators being engaged, where the seal lockdown ring is adapted to be energized with the first energizing force and with the one or more mechanical conditional operators being disengaged, and where the hanger lockdown ring is adapted to be energized with a second energizing force.

BRIEF DESCRIPTION OF THE DRAWINGS

Various embodiments in accordance with the present disclosure will be described with reference to the drawings, in which.

DETAILED DESCRIPTION

Figure 1A:
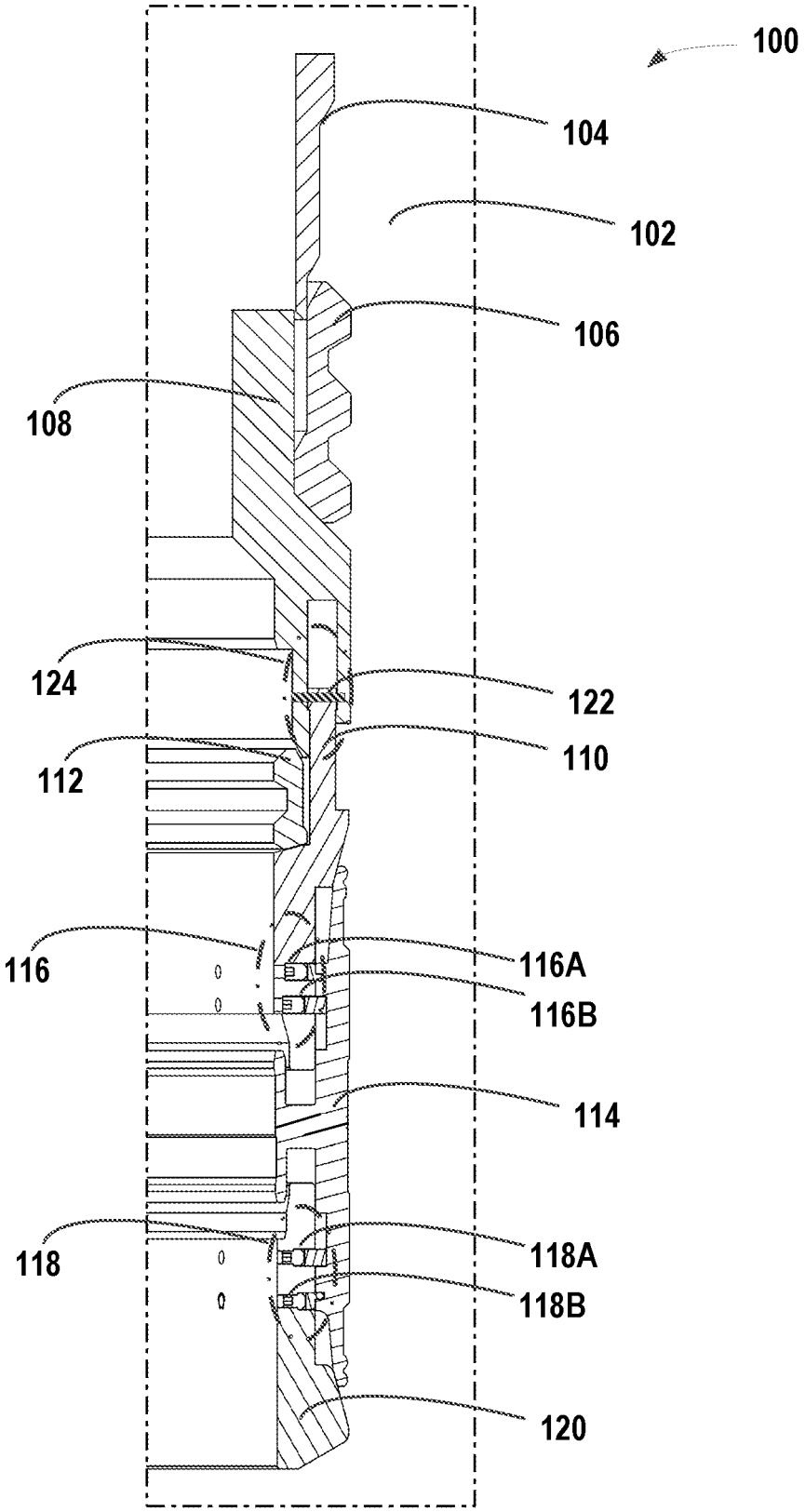
FIG. 1A illustrates a cross-sectional view of a wellhead annulus packoff, in accordance to at least one embodiment.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Various other functions can be implemented within the various embodiments as well as discussed and suggested elsewhere herein. In at least an aspect, the present disclosure is to a system and a method for a wellhead annulus packoff, in accordance to at least one embodiment.

In at least one embodiment, a wellhead annulus packoff that embodies a single trip bi-directional and integral seal with a hanger lockdown ring is disclosed. The single trip is in reference to seal components being run and installed in a single operation. Such a single trip may use a first energizing force for energizing a seal element and a seal lockdown ring and may use a second energizing force to energize a hanger lockdown ring. The single trip, therefore, may include two setting strokes, representing the two energizing forces, in a single operation. The two energizing forces are applied to both energize and retain the at least one seal element and the lockdown rings in an installed position.

In at least one embodiment, such a wellhead annulus packoff simplifies operational tooling required to set or energize a wellhead annulus packoff. The adaption discussed herein also allows the at least one seal element and hanger to be locked down from above the seal element and allows for improved debris tolerance and installation reliability for a wellhead annulus packoff. In a commercial setting, the adaption enables simultaneous setting and locking of a seal, in place, in a single operation. For example, the present adaption is able to engage both, the seal element and the seal lockdown ring in a single operation, without using wickers. In at least one embodiment, engagement and energizing are interchangeably used herein unless otherwise indicated, such as by an engagement feature first followed by an energizing feature.

In at least one embodiment, a wellhead annulus packoff herein is a bi-directional metal-to-metal (MS) annulus seal that includes two annular seals elements that isolate an annular space between a wellhead housing and a hanger, such as the neck of a hanger. At least one MS seal forms an annulus barrier between a volume above and a volume below within the annular space. Further, at least one seal element may be stacked in series to allow for a test volume between the at least one seal element to be formed for an external well barrier integrity testing.

In at least one embodiment, the wellhead annulus packoff is also referred to as a seal that may be characterized in two body portions. A lower seal body includes at least one seal element and an upper seal body that includes a seal lockdown ring, a seal lockdown energizing ring, a hanger lockdown ring, and a hanger lockdown energizing ring. The lockdown rings of the upper seal body represents a lockdown ring retention mechanism to lock the upper seal body to the neck of the hanger and to lock the hanger to the housing. This is so that a hanger-to-housing load may be transferred to the housing. The upper seal body may engage teeth of the seal lockdown ring into a matching lockdown profile in the hanger neck.

A mechanical conditional operator, such as a shear pin, a shear ring, a buckling member, a tensile coupon, or a spring-loaded member allows a setting or energizing force to be transferred through the upper seal body into the lower seal body to energize the at least one seal element. As part of the seal element being energized, the mechanical conditional operator changes the load path to set or energize the seal lockdown ring. For example, the mechanical conditional operator is adapted to disengage, such as by a change to its state or by shearing. Changes in state or shearing may include changes in a shape by collapsing, by buckling or by stressing or tensing. As such, when engaged, there may be a first load path through a mechanical conditional operator, but when disengaged, there may be a second load path through other seal components.

The at least one seal element forms an integrated seal. Once the at least one seal element is energized in place, a further feature herein is to energize other seal components of the wellhead annulus packoff by setting or energizing an external or a hanger lockdown ring to lock the hanger in the wellhead housing. In at least one embodiment, such an adaptation or configuration allows for vastly improved debris tolerance, because a debris pocket can be formed below the wellhead annular packoff, which can accommodate the debris.

FIG. 1A illustrates a cross-sectional view 100 of a wellhead annulus packoff 102, in accordance to at least one embodiment. The wellhead annulus packoff 102 includes at least one seal element, such as a lower seal energizing ring 120 and a seal element 114. The wellhead annulus packoff 102 includes a seal lockdown energizing ring 108, a hanger lockdown energizing ring 104, a seal lockdown ring 112, and a hanger lockdown ring 106. Further, the at least one seal element may be associated with one or more mechanical conditional operators 116A, 118B, 122.

The one or more mechanical conditional operators 116A, 118B, 122 are adapted to disengage following energizing of the at least one seal element and prior to energizing of the seal lockdown ring, using a first energizing force applied through the seal lockdown energizing ring 108. For example, when the mechanical conditional operator is a shear ring or a shear pin, the shear ring or shear pin is adapted to shear upon a first energizing force reaching a certain load. Further, the hanger lockdown ring 106 is adapted to be energized using a second energizing force through the hanger lockdown energizing ring 104, once the seal lockdown ring has been energized.

FIG. 1A also illustrates transfer mechanisms 116B, 118A and mechanical conditional operators 116A, 118B, 122 that may be provided in determined sections 116, 118, 124 of the wellhead annulus packoff 102. The transfer mechanisms 116B, 118A may be associated with the upper seal energizing ring 110 and the lower seal energizing ring 120. In at least one embodiment, a transfer mechanism may be a threaded fastener, a segmented ring, or a split C-ring. The transfer mechanisms 116B, 118A can enable shoulders or surfaces in the provided sections 116, 118 of wellhead annulus packoff 102. Such shoulders or surfaces are so that at least one seal component of the wellhead annulus packoff 102 may be lifted from an annular space during de-energizing of the wellhead annulus packoff 102.

Figure 1B:
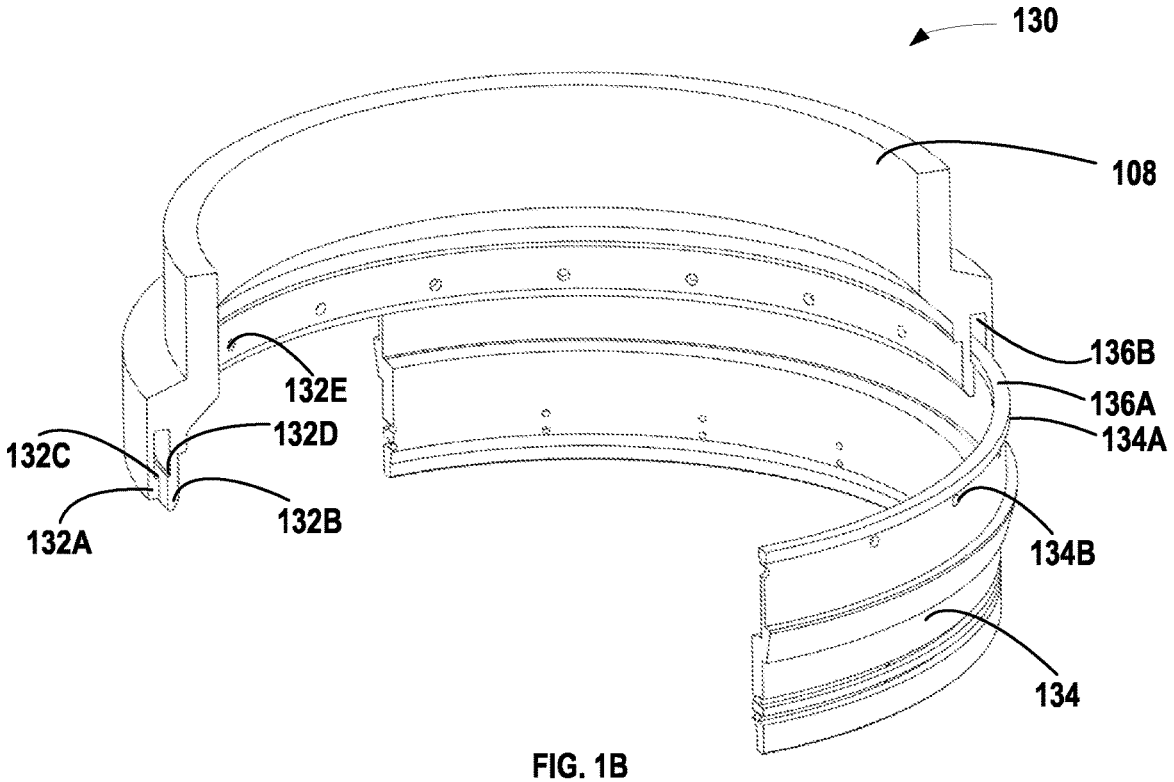
FIGS. 1B, 1C, and 1D illustrate perspective views of a seal lockdown energizing ring associated with an upper seal energizing ring to be installed with a wellhead annulus packoff, in accordance to at least one embodiment.
Figure 1C:
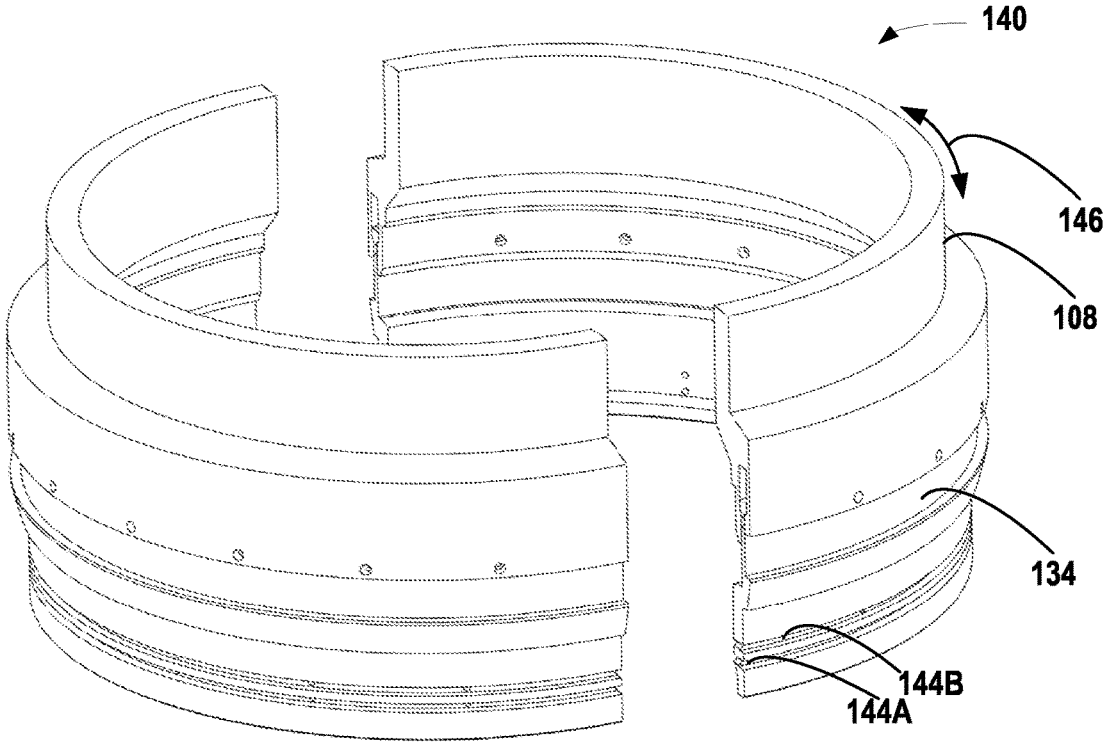
Figure 1D:
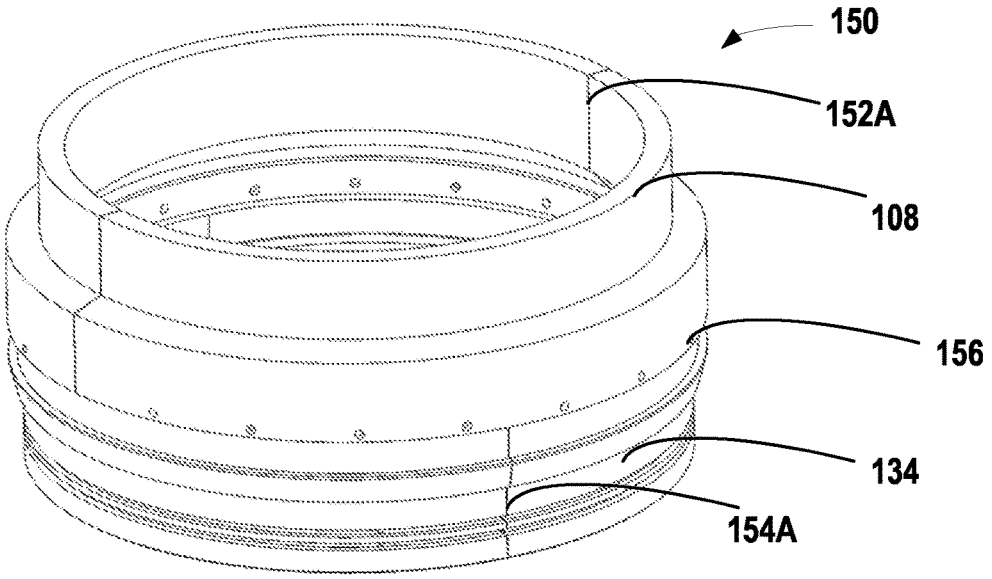

FIGS. 1B, 1C, and 1D illustrate perspective views 130, 140, 150 of a seal lockdown energizing ring 108 associated with an upper seal energizing ring to be installed with a wellhead annulus packoff, in accordance to at least one embodiment. The views illustrated throughout herein are not to scale as is understood by a person of ordinary skill. In FIG. 1B, each of the seal lockdown energizing ring 108 and the upper seal energizing ring 134 are semi-circular members. Each semi-circular member is associated together and then the two associated semi-circular members are brought together as illustrated in FIG. 1C.

FIG. 1A therefore illustrates a wellhead annulus packoff that includes at least one seal element, a seal lockdown energizing ring, a hanger lockdown energizing ring, a seal lockdown ring, a hanger lockdown ring, and one or more mechanical conditional operators. The one or more mechanical conditional operators 116A, 118B, 122 are adapted to disengage during energizing of the wellhead annulus packoff using a first energizing force applied through the seal lockdown energizing ring. Then, a second energizing force may be applied through the hanger lockdown energizing ring for energizing of at least the hanger lockdown ring 106.

In FIG. 1B, the seal lockdown energizing ring 108 is illustrated as being associated with the upper seal energizing ring 134 via a ridge 134A that fits within railings 132C, D defined inside fingers 132A, B of the seal lockdown energizing ring 108. The reference to the seal lockdown energizing ring 108 and the upper seal energizing ring 134 here is understood to be made to the semi-circular members where each semi-circular member undergoes a similar association. In other Figures, the reference to the seal lockdown energizing ring 108 and the upper seal energizing ring 134 will be understood to be a reference to the entire ring with the semi-circular members forming a ring, unless otherwise described.

The association of the seal lockdown energizing ring 108 and the upper seal energizing ring 134 (the semi-circular members of such rings) here is understood to be so that the ridge 134A caught within the railings 132C, 132D may be used to lift the upper seal energizing ring during retrieval of the wellhead annulus packoff. FIG. 1B also illustrates that the seal lockdown energizing ring 108 and the upper seal energizing ring 134 include through holes 132E, 134B which may be used for transfer mechanisms and for mechanical conditional operators.

FIG. 1C illustrates forming the middle and the upper seal energizing rings. Particularly, once each of semi-circular members of the seal lockdown energizing ring 108 and the upper seal energizing ring 134 are associated together, they are rotated 146 relative to each other, so that the semi-circular members of the seal lockdown energizing ring 108 and the upper seal energizing ring 134 are aligned one over the other. FIG. 1C also illustrates that the upper seal energizing ring 134 includes tracks 144A, 144B for a transfer mechanism and/or a mechanical conditional operator. For example, the tracks may include a retainer ring that may enable the seal element to be held with the upper seal energizing ring.

The transfer mechanism, therefore, holds two or more seal components together and helps in retrieval of such seal components. However, the transfer mechanism may not transfer energizing forces during energizing. The mechanical conditional operators may transfer portions of the energizing forces through one or more seal components. In at least one embodiment, some seal components may not have association with a mechanical conditional operator but may only have a transfer mechanisms associated therewith. For example, other than a seal lockdown energizing ring and an upper seal energizing ring, some seal components may only have a transfer mechanisms associated therewith.

FIG. 1C, along with FIG. 1D, also illustrates a locking feature for the semi-circular members, so that, once associated together with the respective halves while siting one or over the other, the seal lockdown energizing ring 108 and the upper seal energizing ring 134 may be rotated relative to each other so that a split or seam 152A of the seal lockdown energizing ring 108 is 90 degree or another angle offset from a split or seam 154A of the upper seal energizing ring 134. This allows the seal lockdown energizing ring 108 and the upper seal energizing ring 134 to be associated together but also allows the seal lockdown energizing ring 108 and the upper seal energizing ring 134 to be locked together for landing purposes into an annular space. The offset of the splits or seams 152A, 154A ensures that the seal lockdown energizing ring 108 and the upper seal energizing ring 134 do not come apart.

In at least one embodiment, the association together of the seal lockdown energizing ring 108 and the upper seal energizing ring 134 also allows relative movement between these two parts. Such relative movement (or stroke) may be limited by a gap between a surface of the ridge 136A and a corresponding mating surface 136B. As such, these two parts may be held together, but can move by a predetermined amount that may be limited by a gap defined between the two interfacing surfaces 136A, 136B. In at least one embodiment, a state of the mechanical condition operator is related to a capability of a relative movement enabled between the seal lockdown energizing ring 108 and the upper seal energizing ring 134. For example, when a shear pin that associates together the seal lockdown energizing ring 108 and the upper seal energizing ring 134, is not sheared, there is no relative movement allowed between these two seal components and hence applied load from an energizing force is transferred through the seal. When the shear pin has sheared, these two seal components can move relative to each other and the applied load to a seal lockdown energizing ring 108, from the energizing force, causes at least the seal lockdown ring 112 to be energized.

Figure 1E:
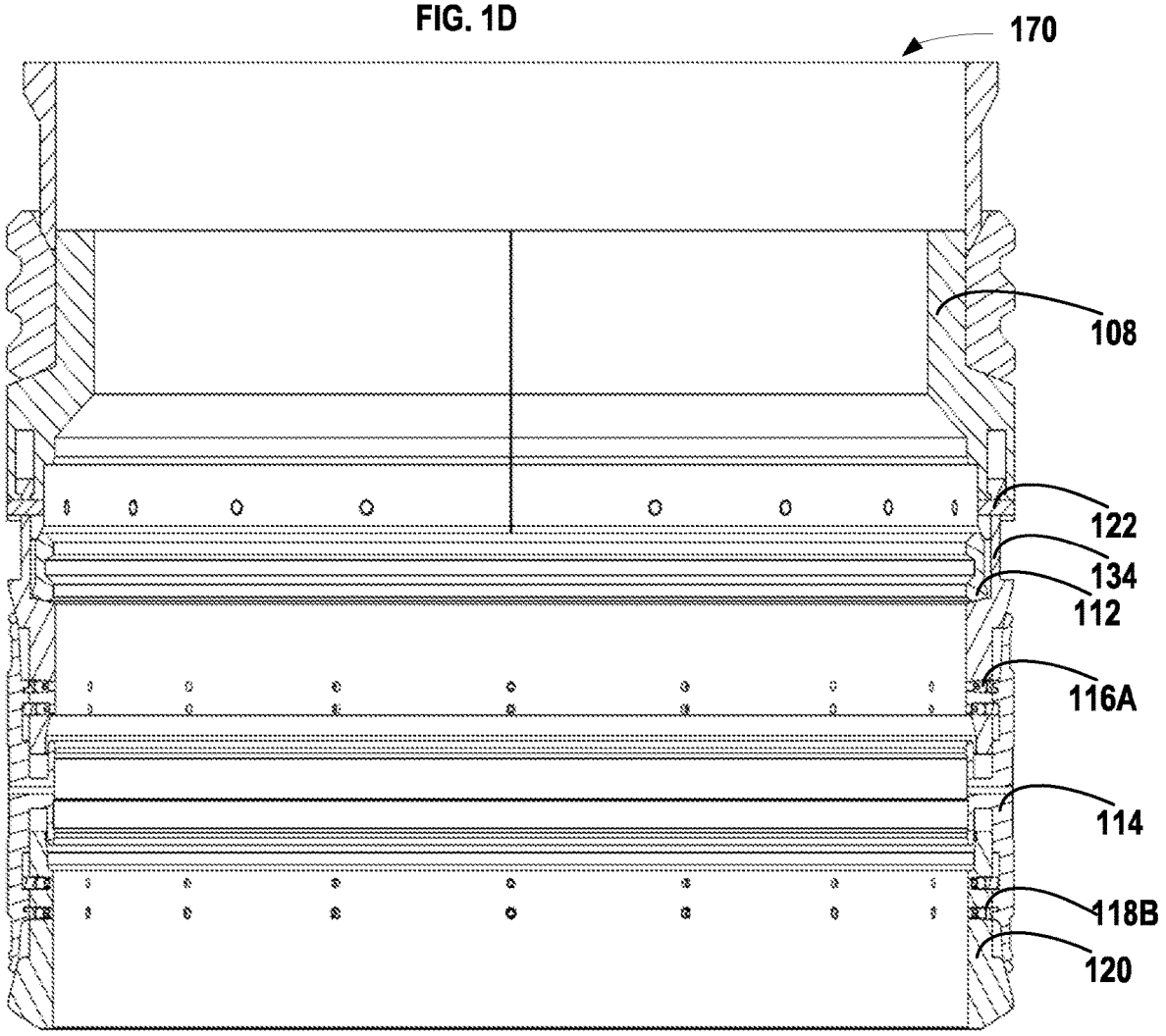
FIG. 1E illustrates a further cross-sectional view of a wellhead annulus packoff, in accordance to at least one embodiment.

FIG. 1E illustrates a further cross-sectional view 170 of a wellhead annulus packoff, in accordance to at least one embodiment. FIG. 1E illustrates at least one seal element 114 provided above and below other seal components. For example, the seal lockdown energizing ring 108 and the upper seal energizing ring 134 are above the seal element 114, while the lower seal energizing ring 120 is below the seal element 114. Further, FIG. 1E illustrates that the aligned through holes (such as, aligned through holes 156 in FIG. 1D), which may be aligned for the seal lockdown energizing ring 108 and the upper seal energizing ring 134. The alignment of the through holes allows shearing pins or other mechanical conditional operators 122 to be provided between the seal lockdown energizing ring 108 and the upper seal energizing ring 134. This may be a further locking features for the seal lockdown energizing ring 108 and the upper seal energizing ring 134 to be landed together in position.

FIG. 1E also illustrates further that mechanical conditional operators 122, 116A, 118B may be provided between the seal lockdown energizing ring 108 and the upper seal energizing ring 134, and separately between the upper seal energizing ring 174 and the seal element 114. The mechanical conditional operators 122, 116A, 118B may be provided to prevent relative motion between seal components during engagement, such as preventing relative movement between the upper seal energizing ring 134 and the seal element 114 during landing; but may be provided also for enabling relative movement after disengagement so an applied energizing force may transfer elsewhere into a seal.

Figure 2:
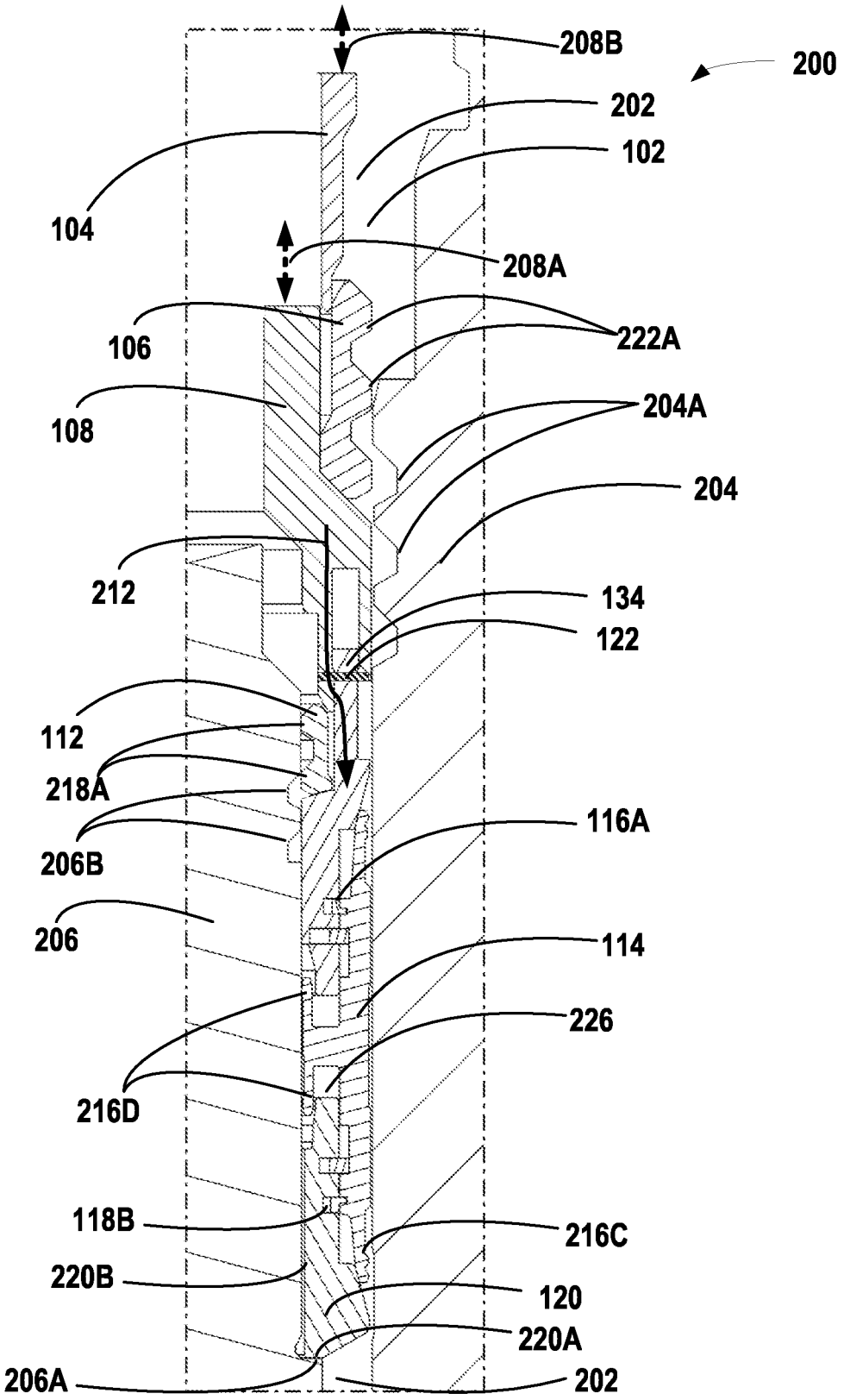
FIG. 2 illustrates a cross-sectional view of a landed wellhead annulus packoff, in accordance to at least one embodiment.

FIG. 2 illustrates a cross-sectional view 200 of a landed wellhead annulus packoff 200A, in accordance to at least one embodiment. The wellhead annulus packoff 200A is landed in an annular or annulus space 202 and on a shoulder 206A of the hanger 206, for instance. Particularly, a bottom surface 220A of a lower seal energizing ring 120 may be abutting a shoulder 206A of the hanger 206. In at least one embodiment, a first energizing force (downward component of the reference arrow 208A) may be enabled to cause, through a seal lockdown energizing ring 108, the at least one seal element, such as seal element 114 and a lower seal energizing ring 120, along with the seal lockdown ring 112, to be energized.

Figure 5:
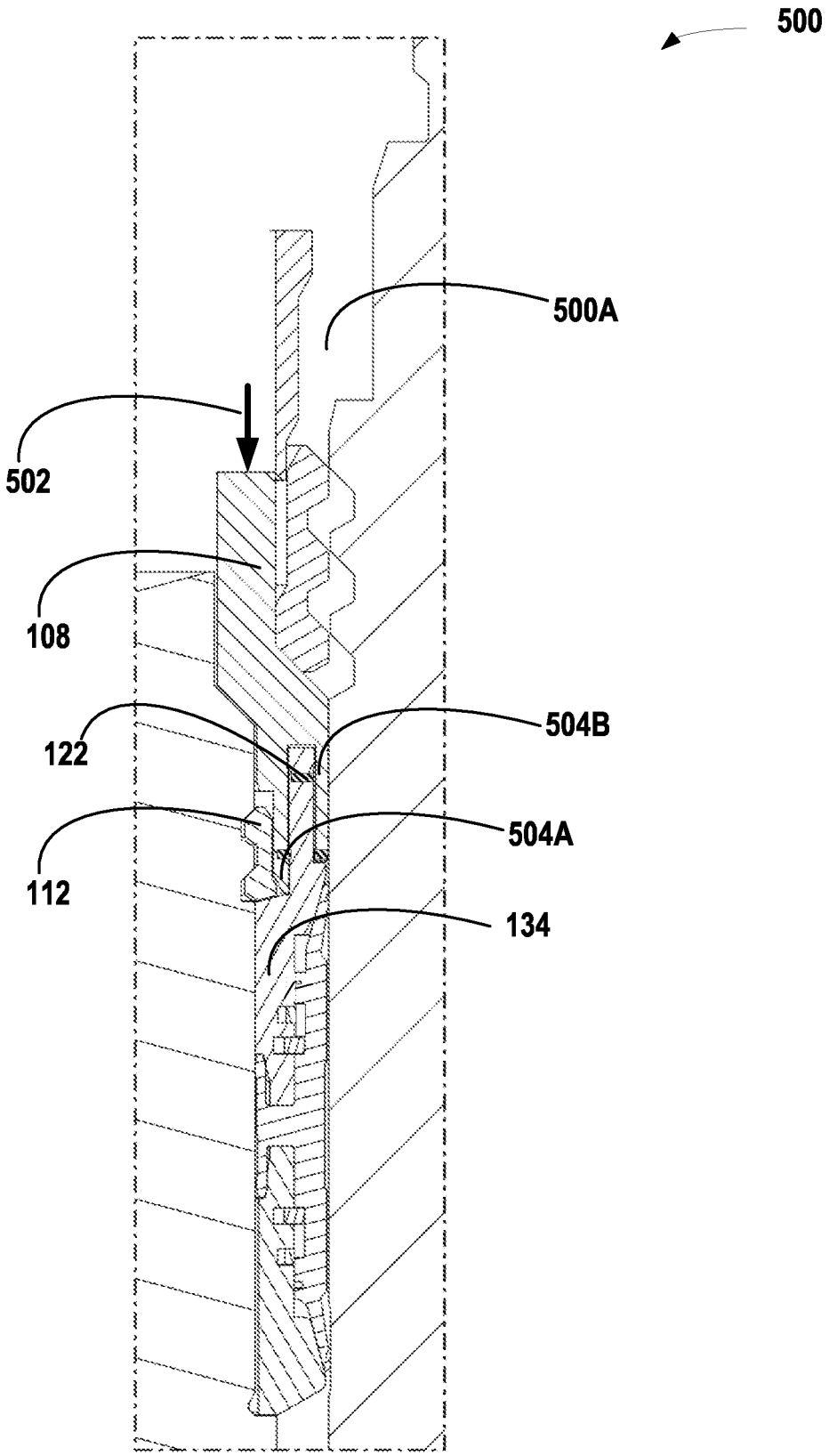
FIG. 5 illustrates a cross-sectional view of a wellhead annulus packoff in a third stage of a partly energized state, in accordance to at least one embodiment.
Figure 6:
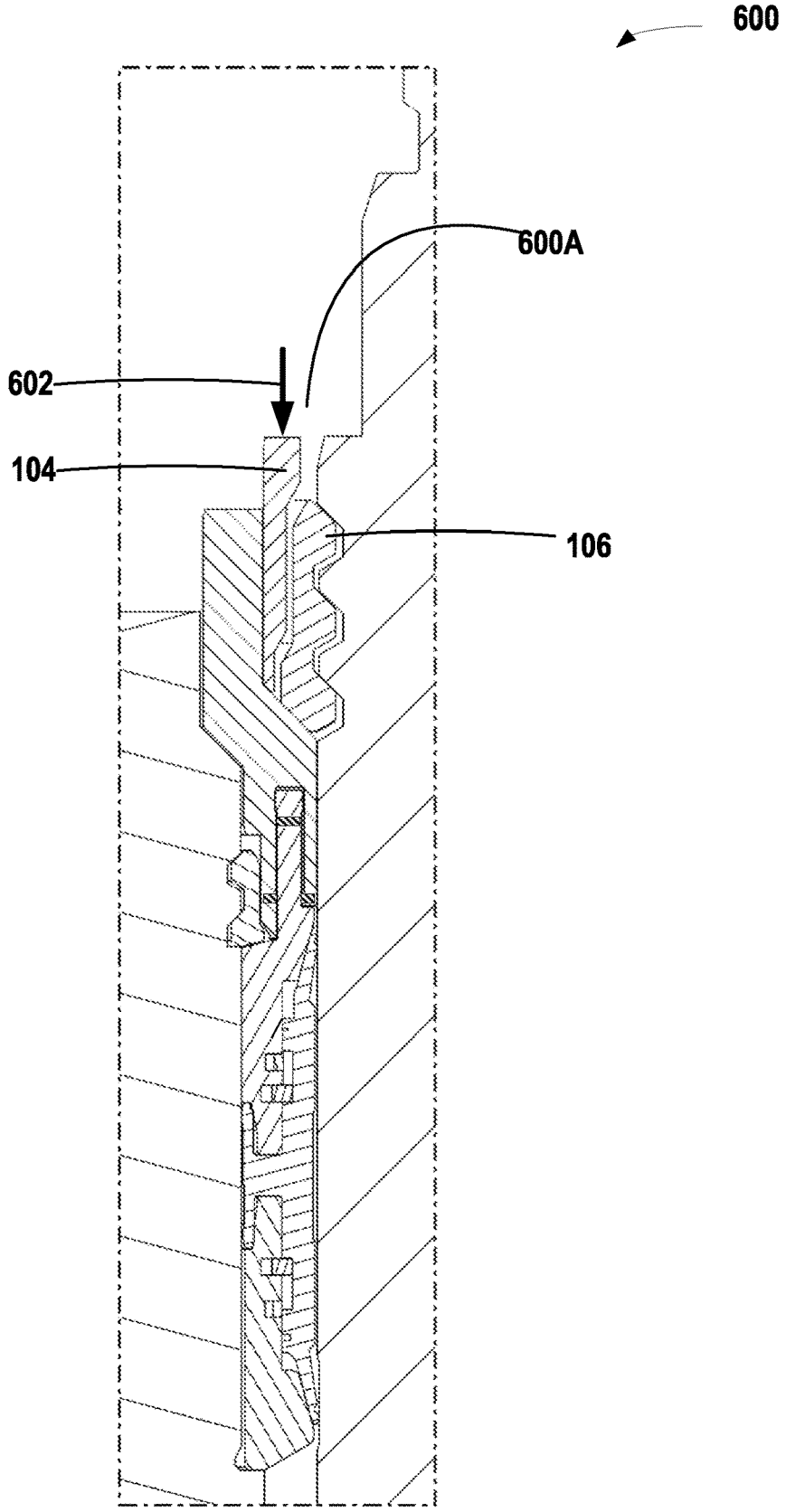
FIG. 6 illustrates a cross-sectional view of a wellhead annulus packoff in a fully energized state, in accordance to at least one embodiment.

In at least one embodiment, a second energizing force (downward component of the reference arrow 208B) may be enabled to cause, through a hanger lockdown energizing ring 104, a hanger lockdown ring 106, to be energized. The first energizing force 208A may be applied as a single continuous stroke or force through the stages illustrated in FIGS. 3 to 5, with FIG. 6 illustration the second energizing force applied for energizing the hanger lockdown ring. The energizing stages are therefore illustrated at least via the stages in FIGS. 3 to 6, following the landing illustrated in FIG. 2, where a fully energized wellhead annulus packoff is illustrated in FIG. 6.

Figure 7:
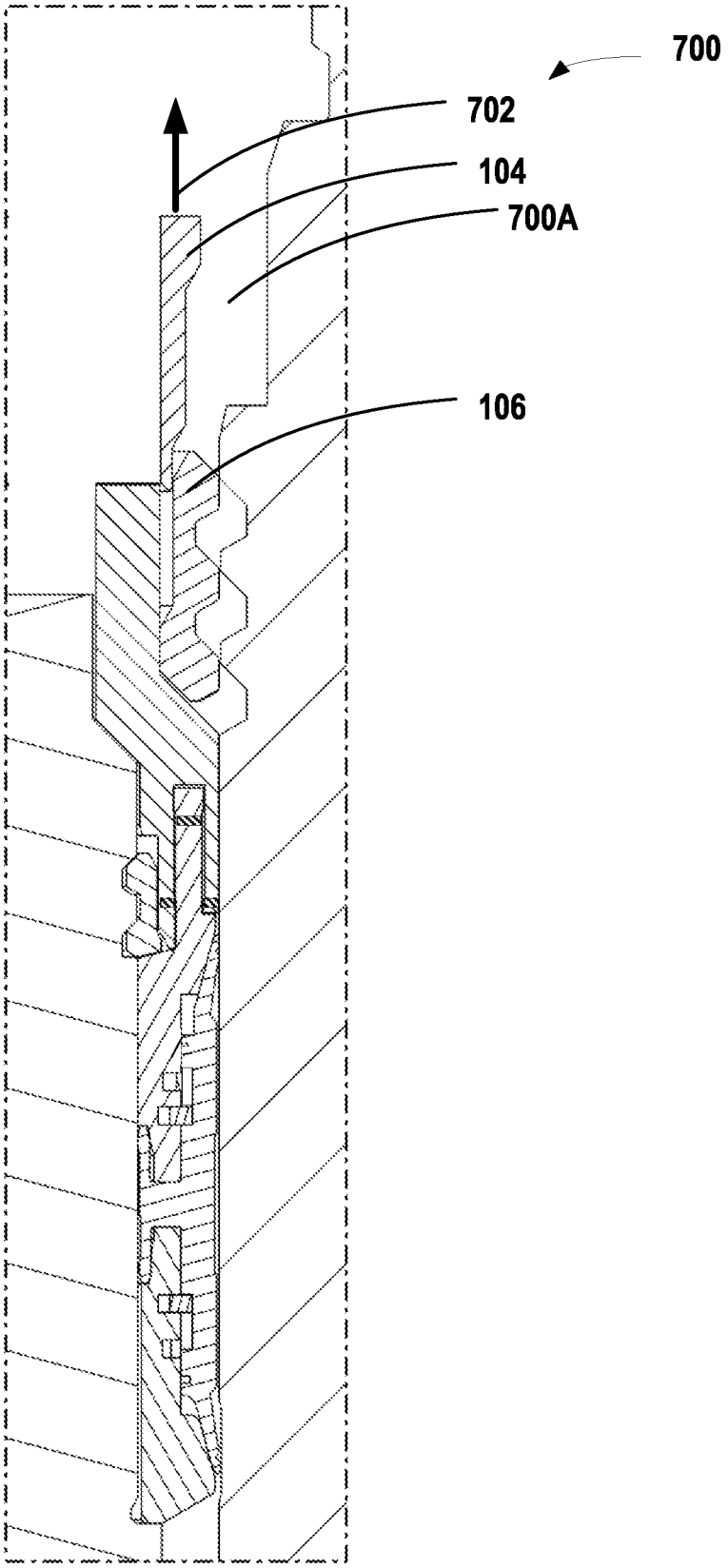
FIG. 7 illustrates a cross-sectional view of a wellhead annulus packoff in a first stage of a partly de-energized state, in accordance to at least one embodiment.

For removal of the wellhead annulus packoff 200A, a first de-energizing force (upward component of the reference arrow 208B) may be applied to cause the hanger lockdown ring 106 to be de-energized. Still further, a second de-energizing force or pulling force (upward component of the reference arrow 208A) may be provided to the seal lockdown energizing ring 108 during removal of the wellhead annulus packoff 200A, in accordance to at least one embodiment. At least the second de-energizing force (upward component 208A) is applied through the stages illustrated in FIGS. 8 to 11, with the first de-energizing force (upward component 208B) applied as illustrated in FIG. 7. The de-energizing stages are therefore illustrated at least via the stages in FIGS. 7 to 10, with FIG. 11 illustrating a removal stage for the wellhead annulus packoff 200A.

In at least one embodiment, the lower seal energizing ring 120 is adapted to sit on a shoulder 206A of the hanger 206. Further, a seal element 114 includes legs, such as an outer bottom leg 216C, that may be subsequently energized by the lower seal energizing ring 120. Further, the lower seal energizing ring 120 may include a straight surface or profile 220B or a toothed surface or profile to engage with a mating profile provided for a hanger 206. Furthermore a seal element 114 may include inner legs 216D that are distinct from the outer bottom leg. In at least one embodiment, the inner legs 216D provided sealing against the hanger 206 when the seal element 114 moves down relative to the hanger 206.

FIG. 2 also illustrates that one or more mechanical conditional operators 118B, 116A are provided with at least the seal element 114. The one or more mechanical conditional operators 122, 118B, 116A may be associated between the seal element 114 and the upper seal energizing ring 134 and/or associated between the seal element 114 and the lower seal energizing ring 120. Further, the one or more mechanical conditional operators 118B, 116A are adapted to disengage or change state during energizing of at least one seal element of the wellhead annulus packoff, such as energizing of the lower seal energizing ring 120 and of the seal element 114.

In at least one embodiment, the seal lockdown ring 112 is illustrated with a toothed surface or profile 218A to mate with a matching profile 206B provided for a hanger 206. Similarly, the hanger lockdown ring 106 may include a toothed surface or profile 222A to mate with a matching profile 204A provided for a housing 204. The first energizing force 208A transfers 212 through the seal lockdown energizing ring 108, the mechanical conditional operator 122, and the upper seal energizing ring 134. Subsequently, a seal element 114 receives the first energizing force 208A from the upper seal energizing ring 134.

In at least one embodiment, part of the first energizing force 208A is transferred via a mechanical conditional operator (122), such as a shear pin. The conditional operator 122 may change state once the seal element 114 is fully energized, and then allows the seal lockdown ring 112 to be set or energized as influenced in part by the second stage 208A of a continuous first energizing force or stroke, which is also illustrated in FIG. 5. FIG. 2 illustrates that such transfers 212 of energizing force may occur via contacting surfaces between the seal lockdown energizing ring 108, the seal lockdown ring 112 and the upper seal energizing ring 134. As such, unless otherwise stated, gaps illustrated between such seal components are not present in an actual physical wellhead annulus packoff 200A. In at least one embodiment, such features enable the bi-directional wellhead annulus packoff with an associated method for energizing using a single operation having a first energizing force applied as a single continuous stroke or force, followed by a second energizing force applied in a first direction to energize a wellhead annulus packoff. An associated method is provided for de-energizing that may be applied in an opposite direction, than the first direction, to de-energize and remove such a wellhead annulus packoff.

Figure 3:
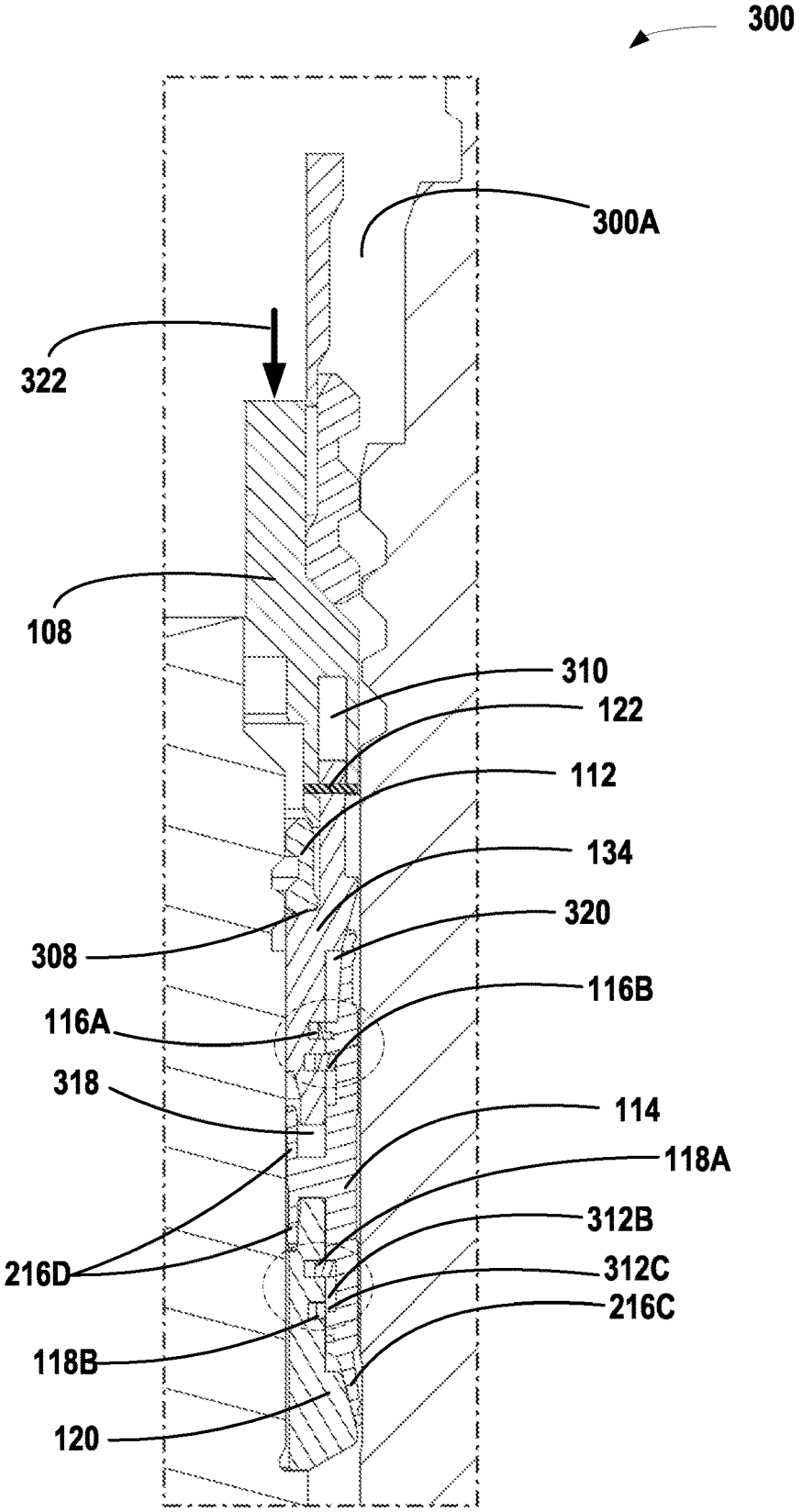
FIG. 3 illustrates a cross-sectional view of a wellhead annulus packoff in a first stage of a partly energized state, in accordance to at least one embodiment.

FIG. 3 illustrates a cross-sectional view 300 of a wellhead annulus packoff 300A in a first stage of a partly energized state, in accordance to at least one embodiment. The first energizing force 322 may be introduced to the seal lockdown energizing ring 108. The first energizing force 322 is a continuous setting or energizing stroke or force applied from this stage till at least the seal lockdown ring 112 is energized (such as, by the stage of FIG. 5). The first energizing force 322, therefore, transfers to the upper seal energizing ring 134 and to the seal element 114, through a mechanical conditional operator that then shears and allows the first energizing force 322 to energize the seal lockdown ring 112 (as in FIG. 5).

Figures 4A, 4B, 4C:
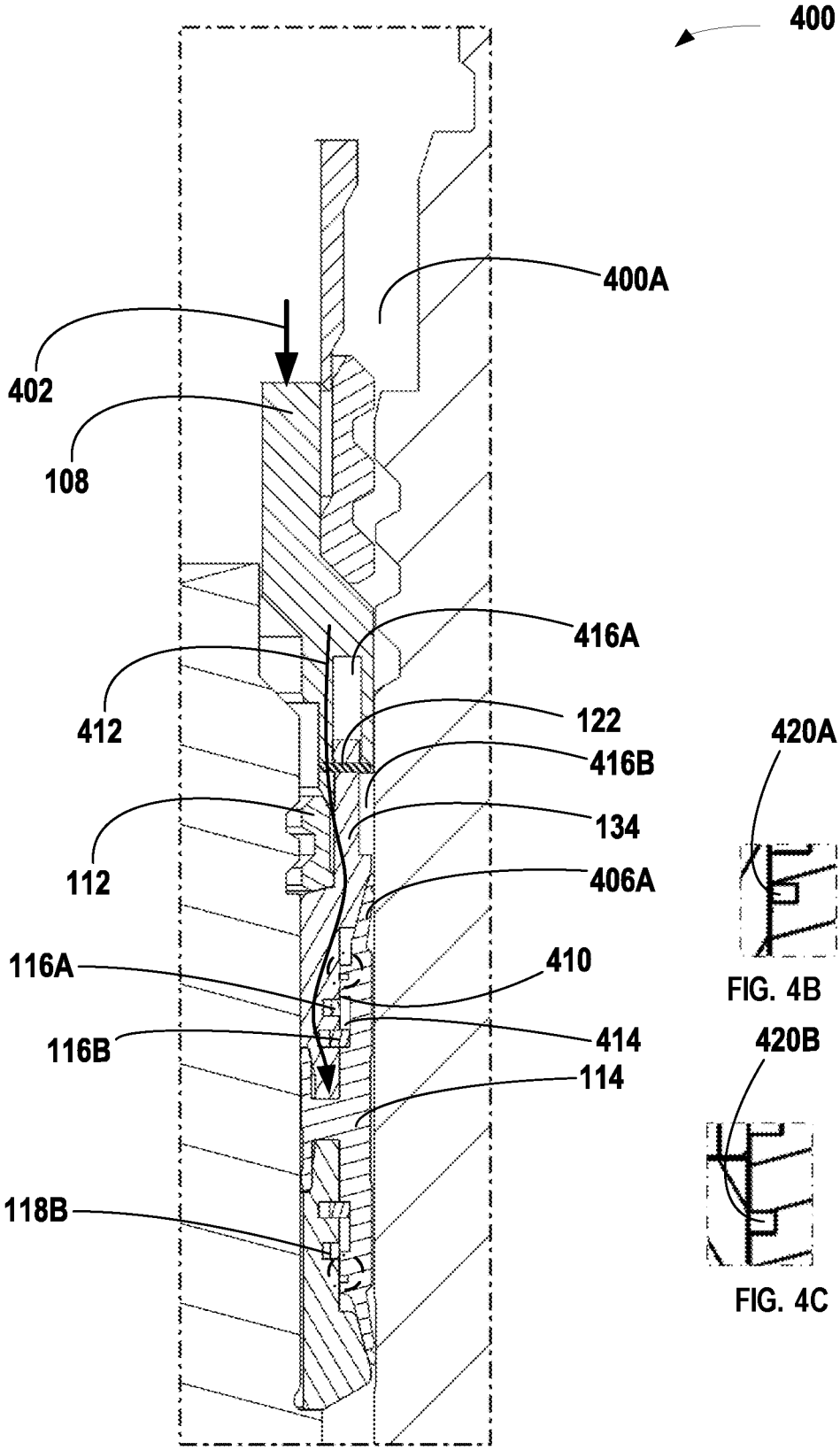
FIGS. 4A, 4B, and 4C illustrate cross-sectional views, including magnified cross-sectional views, of a wellhead annulus packoff or a portion thereof in a second stage of a partly energized state, in accordance to at least one embodiment.

The first energizing force 322 causes the at least one seal element 114 to be energized first, with the lower seal energizing ring 120, by the first energizing force passing through the seal via one or more transfer mechanisms. This is part of a first stage of energizing of the wellhead annulus packoff 300A. Once the seal element 114 is fully energized (which is also illustrated in FIG. 4A), then the mechanical conditional operator 122 changes state, such as by shearing, which allows relative movement between the seal lockdown energizing ring 108 and the upper seal energizing ring 134. Such relative movement allows the first energizing force on the seal lockdown energizing ring 108, which is continued in the first stage after the seal element 114 is fully energized, to also energize the seal lockdown ring 112.

The lower seal energizing ring 120 may be associated with a mechanical conditional operator 118B that is also associated with the seal element 114. In the first stage of the partly energized state, the mechanical conditional operator 118B associated between the lower seal energizing ring 120 and the seal element 114 may be caused to shear or change state in other ways so that one of the at least one seal element may slide against the lower seal energizing ring 120 during energizing of the wellhead annulus packoff 300A. In FIG. 3, the mechanical conditional operator 118B is illustrated as sheared as compared to its initial state 118B, when landed, in FIG. 2.

In at least one embodiment, the shearing of the mechanical conditional operator 118B enables a slot or space 312B to be formed. Further, a surface or shoulder 312C of the seal element 114 is exposed and may be used during de-energizing to allow the seal element 114 support a transfer mechanism 314A during retrieval of the lower seal energizing ring 120 by a pulling force that transfers to the seal element as discussed in at least in FIG. 10. FIG. 3 also illustrates a leg 216C of the seal element 114 that is driven against the lower seal energizing ring 120 to energize seal leg 216C against the housing.

In at least one embodiment, inner legs 216D of a seal element 114 form a seal against a neck of a hanger as the seal element 114 moves down during energizing. In a landed position, such as illustrated in FIG. 2, such inner legs 216D have an internal diameter that is less than an outer diameter of the neck of the hanger, at location in which the sealing is enabled. A relative movement of the inner legs 216D over the neck of the hanger may cause interference. The interference may energize the inner seals 216D with the hanger. Also, the top and bottom inner legs 216D may have different internal diameters, which may interface with different hanger outer diameters at their respective locations. In its energized position, a void 226 (in FIG. 2) that was previously above the lower seal energizing ring 120 and the seal element 114 is closed.

FIG. 3 also illustrates that a further void 318 between the seal element and an upper seal energizing ring 134 remains so that the first energizing force 322 continues to be provided. Particularly, a different mechanical conditional operator 116A that is associated between the upper seal energizing ring 134 and the seal element 114 may be intact and yet to be sheared or to change state in other ways so that another one of the at least one seal element may slide against the upper seal energizing ring 134 during energizing of the wellhead annulus packoff 300A. Still other voids 310, 320 may remain at this first stage of energizing of the wellhead annulus packoff 300A.

In at least one embodiment, FIG. 3 illustrates that the seal element 114 can be energized against a lower seal energizing ring 120 with the first energizing force 322 applied through at least a first one 118B of one or more mechanical conditional operators that has sheared or changed state. In at least one embodiment, FIG. 3 also illustrates that the upper seal energizing ring 134 can transfer at least one part of the first energizing force to the seal element 114 so that the seal element 114 energizes against a lower seal energizing ring 120 in the first stage of energizing of the wellhead annulus packoff.

FIG. 4A illustrates a cross-sectional view 400 of a wellhead annulus packoff 400A in a second stage of a partly energized state, in accordance to at least one embodiment. As the first energizing force 402 is continued at the seal lockdown energizing ring 108 for the energizing of the wellhead annulus packoff 400A, the first energizing force 402 causes the upper seal energizing ring 134 to shear or change state of the mechanical conditional operator 116A (previously noted as 116A in FIG. 3) that is associated between the upper seal energizing ring 134 and the seal element 114. FIGS. 4B and 4C also illustrate residual grooves 420A, 420B in cross-sectional views after shearing and which may contain a sheared piece of the mechanical conditional operator. Further, presence of such residual grooves 420A, 420B represents a change in state of the mechanical conditional operator 116A and 118B. In at least one embodiment, at least shearing of a shear pin may result in residual grooves 420A, 420B on the seal element.

Figure 9:
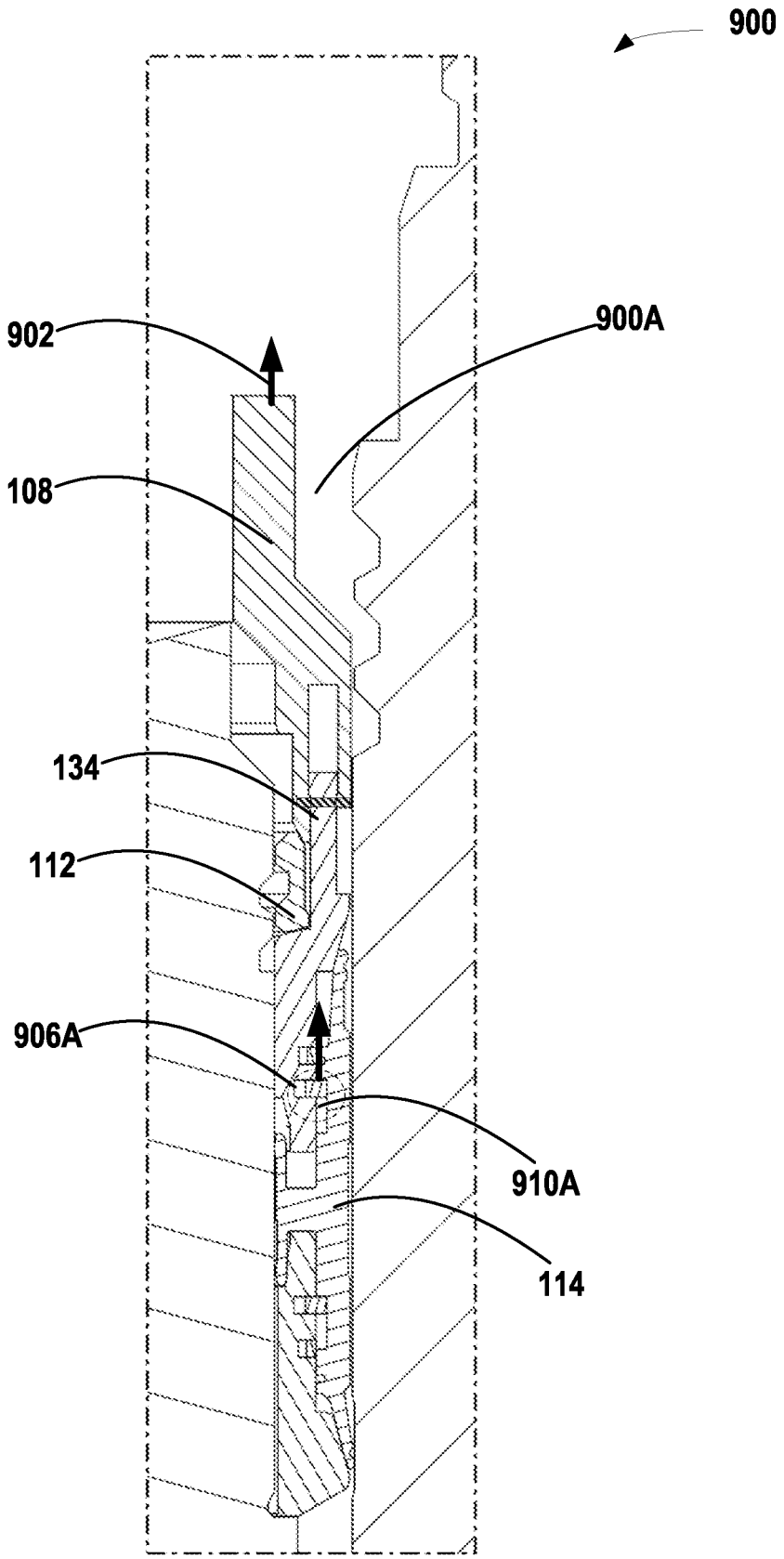
FIG. 9 illustrates a cross-sectional view of a part of a wellhead annulus packoff in a third stage of a partly de-energized state, in accordance to at least one embodiment.

Then, the upper seal energizing ring 134 closes a previously indicated void (318 in FIG. 3) and enables a space or slot 414 for a shoulder 410 for a transfer mechanism 408B to engage during retrieval of the wellhead annulus packoff 400A, which is discussed further in FIG. 9. With support from underneath, provided by the energized lower seal energizing ring and the seal element, the upper seal energizing ring 134 may energize the top outer leg 406A, along with the seal element 114, by the first energizing force 402.

FIG. 4A also illustrates that the wellhead annulus packoff 400A includes the seal element having an upper leg 406A and includes the seal lockdown ring 112. There may be further voids 416A, 416B that remain to be addressed by the upper seal components being energizing by the first energizing force 402 that continues to be applied through the seal lockdown energizing ring 108. In at least one embodiment, the lower seal components (such as, the lower seal energizing ring and the seal element) being energized supports energizing of the upper seal components (such as, the upper seal energizing ring, the seal lockdown energizing ring, the seal lockdown ring, and the hanger lockdown ring).

In at least one embodiment, FIG. 4A illustrates that the upper seal energizing ring 134 can energize the seal element 114 with the first energizing force applied after a second one 116A of the one or more mechanical conditional operators has sheared or changed state. In at least one embodiment, the seal lockdown energizing ring 108 has transferred at least one part of the first energizing force to the upper seal energizing ring 134 so that the upper seal energizing ring 134 energizes a seal element 114 in the second stage of energizing of the wellhead annulus packoff.

In at least one embodiment, a third one 122 of the one or more mechanical conditional operators, also illustrated as reference numeral 122 in FIG. 1E, has not sheared yet and allows the first energizing force to be transferred 412 through the seal lockdown energizing ring 108 and through the upper seal energizing ring 134. In at least one embodiment, the top inner and outer legs of the seal element may be energized before the bottom inner and outer legs of the seal element are energized. In at least one embodiment, both the top and the bottom inner and outer legs of the seal element may be energized simultaneously. Therefore, an order of engagement of the upper and lower seal energizing rings may not be restrictive. For example, the top inner and outer legs of the seal element may be set or energized by the upper seal energizing ring, prior to the bottom inner and outer legs of the seal element being set or energized by the lower seal energizing ring.

FIG. 5 illustrates a cross-sectional view 500 of a wellhead annulus packoff 500A in a third stage of a partly energized state, in accordance to at least one embodiment. As the single continuous stroke or force 502 is applied through the seal lockdown energizing ring 108, the remaining voids in the upper seal components of the upper seal energizing ring 134, the seal lockdown energizing ring 108, the seal lockdown ring 112 close. In at least one embodiment, the seal lockdown ring 112 may be an outwards biased split C-ring. For example, the mechanical conditional operator 122 (previously illustrated as reference numeral 122 in FIG. 1E that had not sheared) is now sheared or has changed state (shear occurs when a shear pin is used as the mechanical conditional operator). Once sheared, relative movement between the seal lockdown energizing ring 108 and the upper seal energizing ring 134 occurs.

Particularly, with the lower seal components being energized and offering support from underneath to the upper seal components, the first energizing force 502 cannot cause further movements to the lower seal components and instead causes the seal lockdown energizing ring to settle between the seal lockdown ring 112 and the upper seal energizing ring 134. A finger 504A of the seal lockdown energizing ring may energize the seal lockdown ring 112 with support 308 from the upper seal energizing ring 134 and another finger 504B of the seal lockdown energizing ring 108. A finger 504A of the seal lockdown energizing ring 108 causes inward radial movement (such as, towards an axis of a wellbore) of the seal lockdown ring 112. This allows the seal lockdown ring 112 to be driven towards engagement with a matching profile on a neck of the hanger. The seal lockdown ring is made to sit within a matching profile of the hanger.

FIG. 6 illustrates a cross-sectional view 600 of a wellhead annulus packoff 600A in a fully energized state, in accordance to at least one embodiment. FIG. 6 also illustrates that a second energizing force 602 may be applied, different from the first energizing force applied as a single continuous stroke or force to achieve different stages one to four of energizing, in FIGS. 3 to 5. The second energizing force 602 may be applied once the seal lockdown ring is energized and may be applied to a hanger lockdown energizing ring 104. The second energizing force 602 causes at least the hanger lockdown ring 106 to be energized against a matching profile of the housing. The hanger lockdown ring 106 may be an inwards biased split C-ring. The hanger lockdown energizing ring 104 may cause outward radial movement (such as, away from an axis of a wellbore) of the hanger lockdown ring 106. This allows the hanger lockdown ring 106 to be driven towards engagement with a matching profile on the housing. The wellhead annulus packoff 600A is therefore in a fully energized state.

FIG. 7 illustrates a cross-sectional view 700 of a wellhead annulus packoff 700A in a first stage of a partly de-energized state, in accordance to at least one embodiment. Initially a first de-energizing force 702 may be applied as a pulling force to the hanger lockdown energizing ring 704. As the hanger lockdown energizing ring 104 has been pulled up, the hanger lockdown ring 106 releases and both these seal components may be removed. In at least one embodiment, removal of radial support, previously provided by a hanger lockdown energizing ring 104 to the hanger lockdown ring 106, enables an inwards bias of the hanger lockdown ring 106 to activate thereby retracting away the hanger lockdown ring 106 from a matching profile in the housing.

Figure 8:
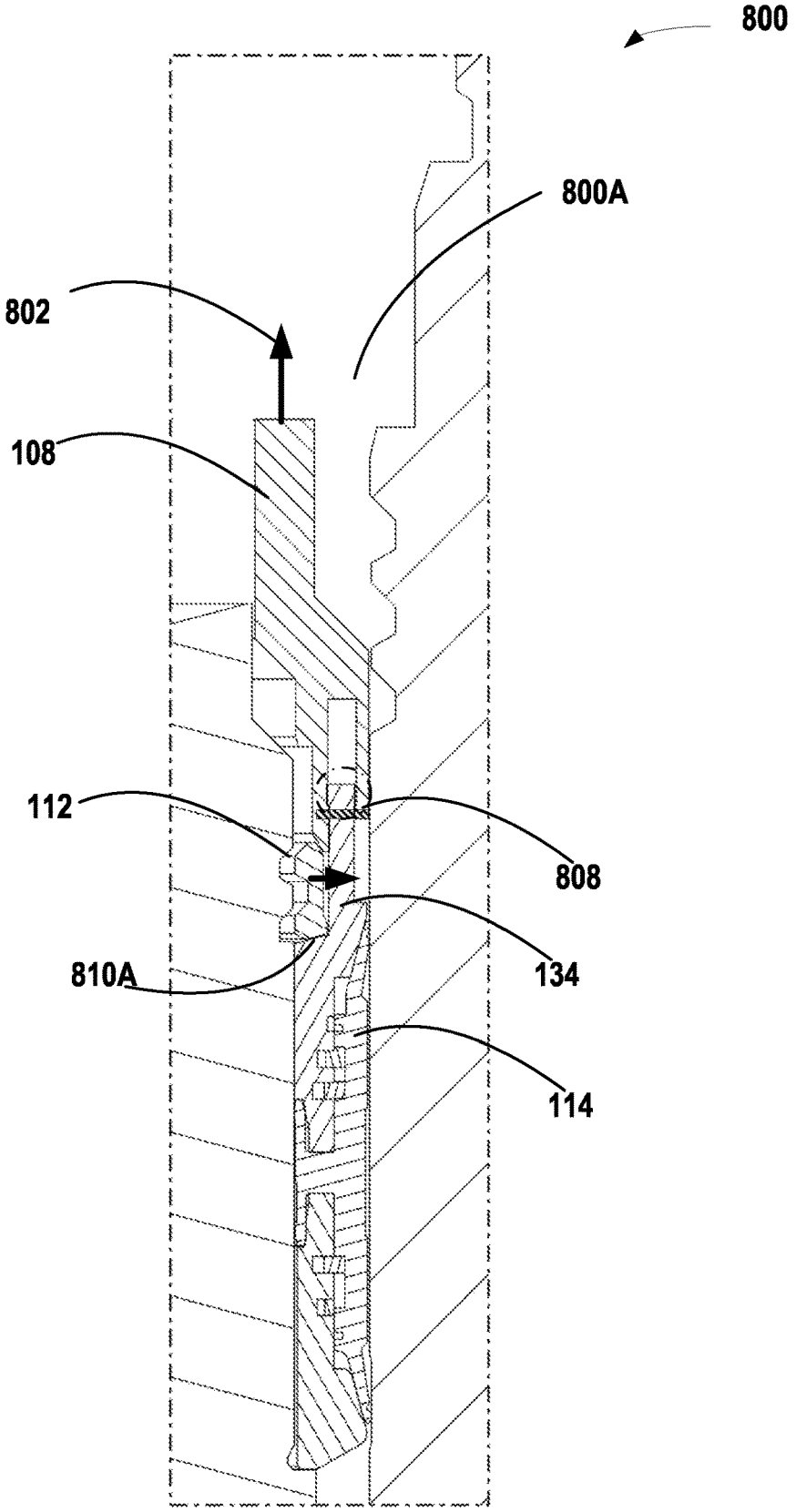
FIG. 8 illustrates a cross-sectional view of a part of a wellhead annulus packoff in a second stage of a partly de-energized state, in accordance to at least one embodiment.

FIG. 8 illustrates a cross-sectional view 800 of a part of a wellhead annulus packoff 800A in a second stage of a partly de-energized state, in accordance to at least one embodiment. With the hanger lockdown energizing ring and the hanger lockdown ring removed (for illustrative purposes), a second de-energizing force 802 that is a single continuous de-energizing stroke or force may be applied through the seal lockdown energizing ring 108. In at least one embodiment, the hanger lockdown energizing ring and the hanger lockdown ring are not fully removed, but in this stage, the hanger lock down ring and the hanger lockdown energizing ring will remain associated with the wellhead annulus packoff 800A, but in the unenergized state. This at least causes a finger of the seal lockdown energizing ring 108 to release from against the seal lockdown ring 112. The seal lockdown ring 112 may be released as a result.

The removal of radial support, previously provided by at least a finger of the seal lockdown energizing ring 108 to the seal lockdown ring 112 can cause an outwards bias of the seal lockdown ring 806 to activate and enables the seal lockdown ring 112 to retract away from a matching profile in the hanger. The second de-energizing force 802 also allows a flange of the upper seal energizing ring 134 to catch within a narrow neck between the fingers of the seal lockdown energizing ring in the area 808 illustrated in FIG. 8. Such a catch allows the second de-energizing force 802 to transfer to the upper seal energizing ring 134 to be pulled upwards for de-energizing the seal element 114. Also illustrated is that a shoulder 810A of the upper seal energizing ring provides support to lift the seal lockdown ring 112 out of the annular space.

FIG. 9 illustrates a cross-sectional view 900 of a part of a wellhead annulus packoff 900A in a third stage of a partly de-energized state, in accordance to at least one embodiment. As the second de-energizing force 902 is continuously applied via the seal lockdown energizing ring 108, the second de-energizing force 902 is transferred in part to the upper seal energizing ring 134 so that it can support the seal lockdown ring 112 being removed and can also catch against a shoulder or surface of the seal element 114. Particularly, a transfer mechanism 906A engages the shoulder or surface of the seal element 114 after moving through a slot or space 910A enabled by a mechanical conditional operator. With the seal element 114 caught on the transfer mechanism 906A, the seal element 114 is caused to be removed by the same second de-energizing force 902 transferred through the seal element 114.

Figure 10:
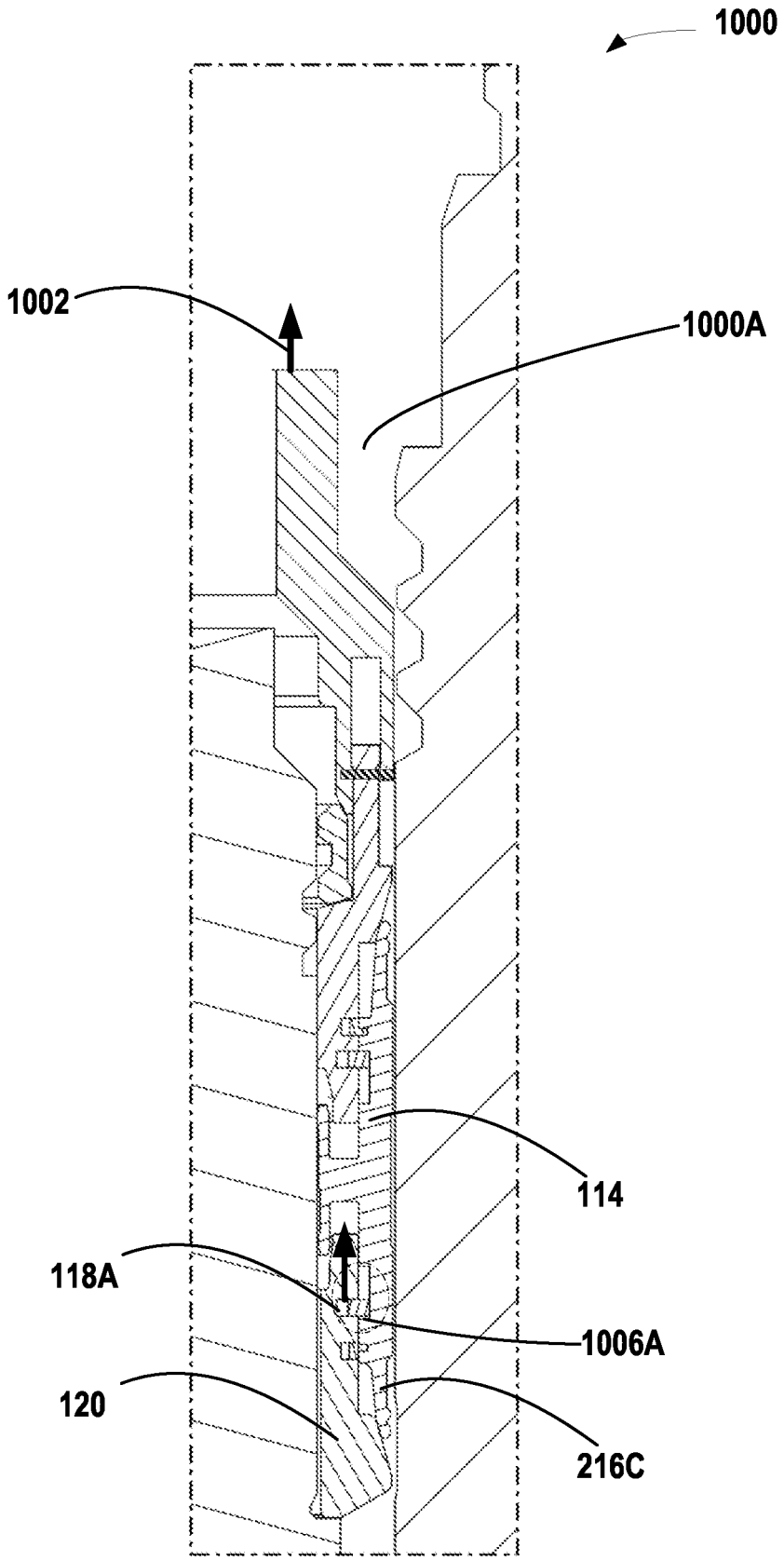
FIG. 10 illustrates a cross-sectional view of a part of a wellhead annulus packoff in a fully de-energized state, in accordance to at least one embodiment.
Figure 11:
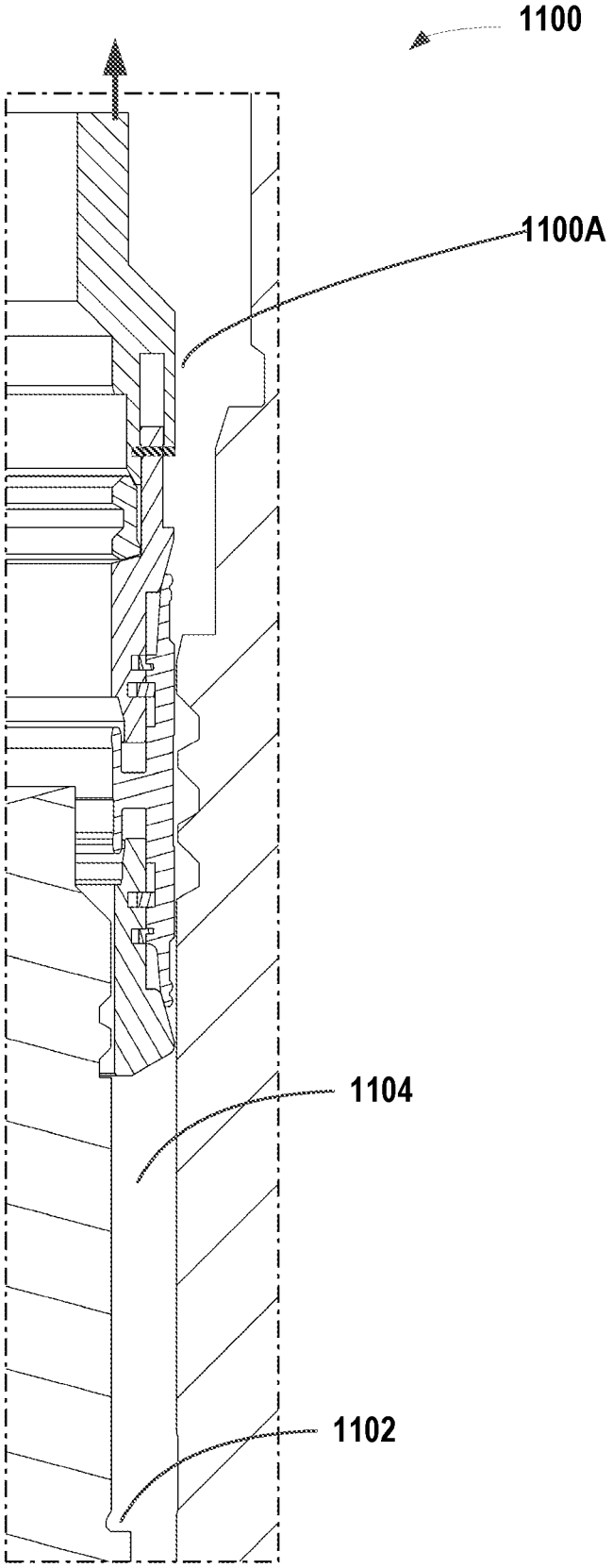
FIG. 11 illustrates a cross-sectional view of a part of a wellhead annulus packoff in a removal stage, in accordance to at least one embodiment.

FIG. 10 illustrates a cross-sectional view 1000 of a part of a wellhead annulus packoff 1000A in a fully de-energized state, in accordance to at least one embodiment. As the second de-energizing force 1002 continues to be applied and transferred through the seal element 114, a leg 216C of the seal element 114 releases from against the lower seal energizing ring 120. The seal element 114 being removed also causes a shoulder 1006A of the seal element to catch on a transfer mechanism 118A of the lower seal energizing ring 120. Such a catch causes the lower seal energizing ring 120 to be removed with the seal element 114. The wellhead annulus packoff 1000A is in a fully de-energized state.

FIG. 11 illustrates a cross-sectional view 1100 of a part of a wellhead annulus packoff 1100A in a removal stage, in accordance to at least one embodiment. FIG. 11 illustrates that, as the second de-energizing force is continued, the wellhead annulus packoff 1100A is removed from the shoulder 1102 of the hanger and from the annular space 1104 between the hanger and the housing. The lower seal energizing ring provides the lower most seal component to support the remaining seal components being removed, but each seal component is associated with a prior seal component via shoulders, surfaces, or transfer mechanisms, as discussed.

Figure 12A:
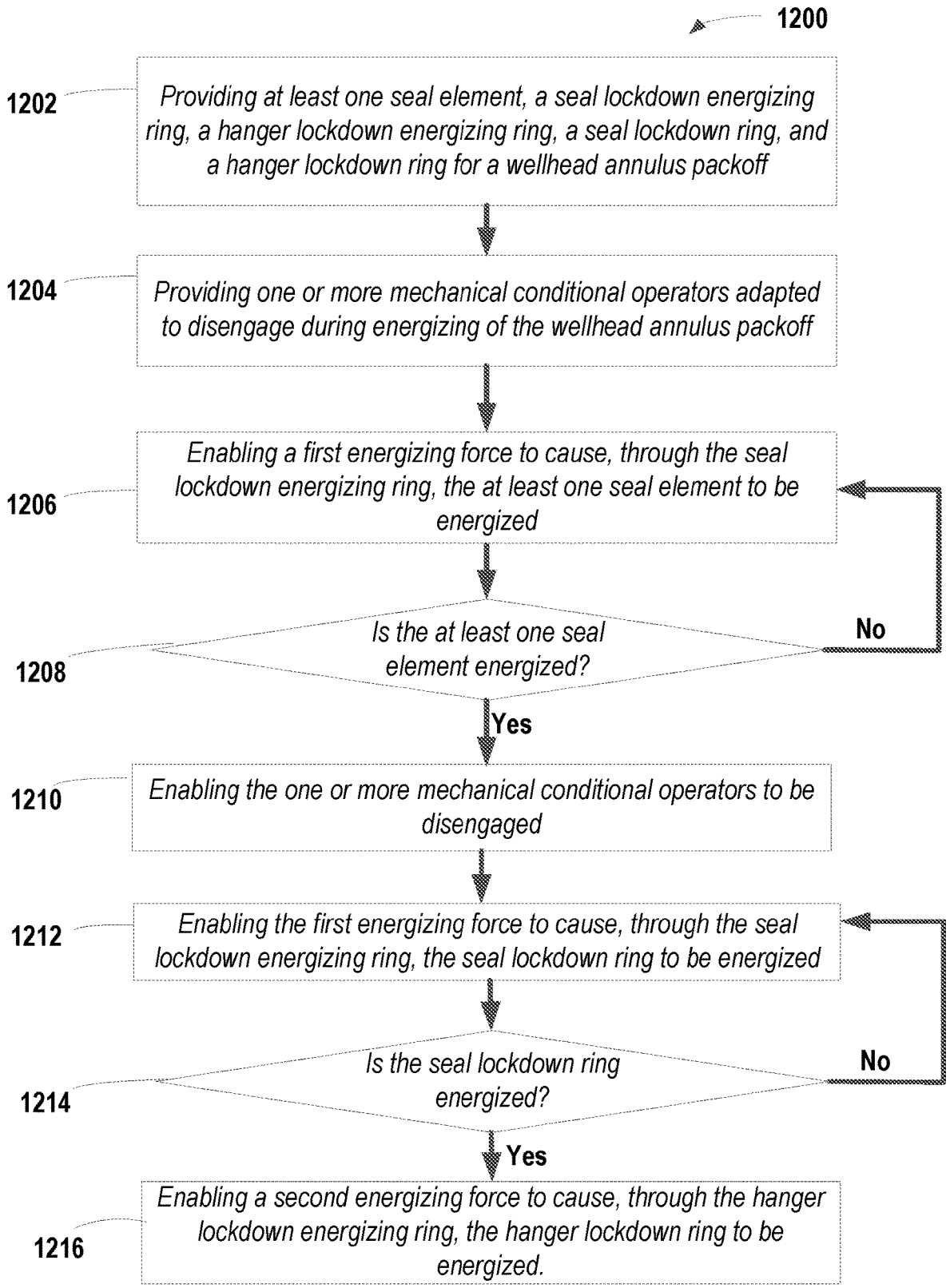
FIG. 12A is a flowchart illustrating a method for energizing in a wellhead annulus packoff, in accordance to at least one embodiment.

FIG. 12A is a flowchart illustrating a method 1200 for energizing in a wellhead annulus packoff, in accordance to at least one embodiment. The method 1200 includes providing (1202) at least one seal element, a seal lockdown energizing ring, a hanger lockdown energizing ring, a seal lockdown ring, and a hanger lockdown ring for a wellhead annulus packoff. The method includes providing (1204) one or more mechanical conditional operators that are adapted to disengage during energizing of the at least one seal element of the wellhead annulus packoff. A verification step may be provided to verify that the wellhead annulus packoff is properly landed. A step 1204 or other steps may be repeated if the verification fails. A further step 1206 may be performed otherwise.

The method 1200 includes enabling (1206) a first energizing force to cause, through the seal lockdown energizing ring, the at least one seal element to be energized. A verification step 1208 is performed to verify that the seal element is engaged or energized, otherwise the prior enabling (1206) step may be repeated. Upon successful verification in step 1208, another step in the method 1200 includes causing (1210) one or more mechanical conditional operators to disengage, such as to become sheared or to change state, as the first energizing force is continued.

With the one or more mechanical conditional operators disengaged, such as be sheared or change in state, a further step in the method 1200 includes enabling (1212) the first energizing force to continue further to cause, through the seal lockdown energizing ring, the seal lockdown ring to be energized. A verification step 1214 may occur to ensure that the seal lockdown ring is energized. Upon positive verification, step 1216 may occur; otherwise, step 1212 may be repeated.

The method 1200 includes enabling (1216) a second energizing force to cause, through the hanger lockdown energizing ring, the hanger lockdown ring to be energized. In at least one embodiment, one or more of the steps in the method 1200 may be performed in a combined manner with a built-in verification, such as steps 1206 to 1212 may be performed together with the verification step 1208 as a single continue stroke using the first energizing force and using load limits mechanically built into the one or more mechanical conditional operators.

The method 1200 may include further steps or sub-steps for associating the one or more mechanical conditional operators with the at least one seal element or the seal lockdown energizing ring. The method 1200 may include further steps or sub-steps for causing the one or more mechanical conditional operators to shear or change state as part of the disengagement during energizing of the wellhead annulus packoff.

The method 1200 may include further steps or sub-steps for enabling the first energizing force to be applied as a single continuous force to the seal lockdown energizing ring. Further, a first part of the single continuous force causes the at least one seal element to be energized. A second part of the single continuous force causes the one or more mechanical conditional operators adapted to be disengaged. A third part of the single continuous force causes the one or more mechanical conditional operators adapted to disengage causes the seal lockdown ring to be energized.

The method 1200 may include further steps or sub-steps for enabling, using the first energizing force, the at least one seal element (such as, the bottom inner leg, top inner leg, and bottom outer leg of the seal element) to be energized through a first relative movement against the lower seal energizing ring. The first relative movement may be enabled by a disengagement of a first one of the one or more mechanical conditional operators. The method 1200 may include further steps or sub-steps for enabling, using the first energizing force, the at least one seal element to be energized through a second relative movement against an upper seal energizing ring. The second relative movement may be enabled by a disengagement of a second one of the one or more mechanical conditional operators.

The method 1200 may include further steps or sub-steps for enabling one of the one or more mechanical conditional operators to transfer at least one part of the first energizing force, through an upper seal energizing ring, to the at least one seal element. The at least one seal element can energize with a lower seal energizing ring in a first stage of the energizing of the wellhead annulus packoff. The method 1200 may include further steps or sub-steps for enabling the seal lockdown energizing ring to transfer at least another part of the first energizing force to an upper seal energizing ring, with the one of the one or more mechanical conditional operators being disengaged. The at least one seal element can energize with the upper seal energizing ring in a second stage of the energizing of the wellhead annulus packoff.

The method 1200 may include further steps or sub-steps for enabling, using the first energizing force, the upper seal energizing ring to energize with the at least one seal element and with the seal lockdown ring in a third stage of the energizing of the wellhead annulus packoff. The method 1200 may include further steps or sub-steps for enabling, using the second energizing force, the hanger lockdown energizing ring to energize with the hanger lockdown ring and with the seal lockdown energizing ring to provide a fully energized stage of the wellhead annulus packoff.

Figure 12B:
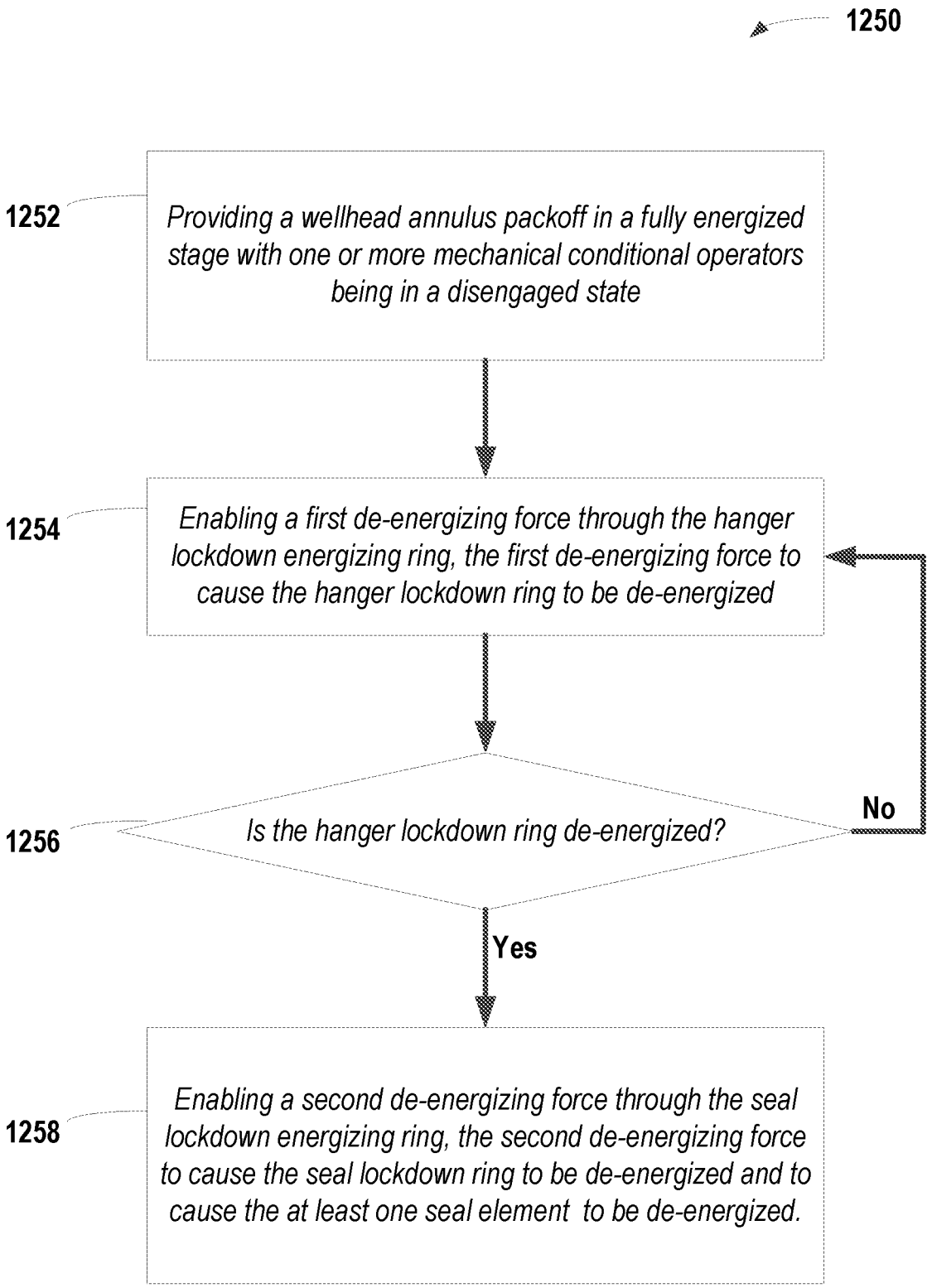
FIG. 12B is a flowchart illustrating a further method for de-energizing in a wellhead annulus packoff, in accordance to at least one embodiment.

FIG. 12B is a flowchart illustrating a further method 1250 for de-energizing in a wellhead annulus packoff, in accordance to at least one embodiment. The method 1250 is applicable to a wellhead annulus packoff that is in a fully energized stage with the one or more mechanical conditional operators being in a disengaged state. The wellhead annulus packoff includes at least one seal element, a seal lockdown energizing ring, a hanger lockdown energizing ring, a seal lockdown ring, a hanger lockdown ring, and the one or more mechanical conditional operators, with the one or more mechanical conditional operators being in the disengaged state with the wellhead annulus packoff in a fully energized stage.

When provided (1252) with such a wellhead annulus packoff that is in a fully energized stage, the method includes enabling (1254) a first de-energizing force through the hanger lockdown energizing ring. The first de-energizing force can cause the hanger lockdown ring to be de-energized. A verification step 1256 verifies that the hanger lockdown ring is de-energized. The prior enabling step 1254 may be otherwise repeated. Upon successful verification, a further enabling (1258) step may be performed for a second de-energizing force through the seal lockdown energizing ring. The second de-energizing force can cause the seal lockdown ring to be de-energized and can cause the at least one seal element to be de-energized.

The method 1250 may include further steps or sub-steps for enabling, using first shoulders or surfaces, transfer of the second de-energizing force from the seal lockdown energizing ring to the upper seal energizing ring. The method 1250 may include further steps or sub-steps for enabling, using second shoulders or surfaces, transfer of the second de-energizing force, from the upper seal energizing ring to the at least one seal element. Further, the method 1250 may include further steps or sub-steps for enabling, using third shoulders or surfaces, transfer of the second de-energizing force, from the seal element to a lower seal energizing ring so that the wellhead annulus packoff is de-energized.

It should be appreciated that embodiments herein may utilize one or more values that may be experimentally determined or correlated to certain performance characteristics based on operating conditions under similar or different conditions. The present disclosure described herein, therefore, is well adapted to carry out the objects and attain the ends and advantages mentioned, as well as others inherent therein. While a presently preferred embodiment of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure disclosed herein and the scope of the appended claims.

While techniques herein may be subject to modifications and alternative constructions, these variations are within spirit of present disclosure. As such, certain illustrated embodiments are shown in drawings and have been described above in detail, but these are not limiting disclosure to specific form or forms disclosed; and instead, cover all modifications, alternative constructions, and equivalents falling within spirit and scope of disclosure, as defined in appended claims.

Terms such as a, an, the, and similar referents, in context of describing disclosed embodiments (especially in context of following claims), are understood to cover both singular and plural, unless otherwise indicated herein or clearly contradicted by context, and not as a definition of a term. Including, having, including, and containing are understood to be open-ended terms (meaning a phrase such as, including, but not limited to) unless otherwise noted. Connected, when unmodified and referring to physical connections, may be understood as partly or wholly contained within, attached to, or joined together, even if there is something intervening.

Recitation of ranges of values herein are merely intended to serve as a shorthand method of referring individually to each separate value falling within range, unless otherwise indicated herein and each separate value is incorporated into specification as if it were individually recited herein. In at least one embodiment, use of a term, such as a set (for a set of items) or subset unless otherwise noted or contradicted by context, is understood to be nonempty collection including one or more members. Further, unless otherwise noted or contradicted by context, term subset of a corresponding set does not necessarily denote a proper subset of corresponding set, but subset and corresponding set may be equal.

Conjunctive language, such as phrases of form, at least one of A, B, and C, or at least one of A, B and C, unless specifically stated otherwise or otherwise clearly contradicted by context, is otherwise understood with context as used in general to present that an item, term, etc., may be either A or B or C, or any nonempty subset of set of A and B and C. In at least one embodiment of a set having three members, conjunctive phrases, such as at least one of A, B, and C and at least one of A, B and C refer to any of following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, terms such as plurality, indicates a state of being plural (such as, a plurality of items indicates multiple items). In at least one embodiment, a number of items in a plurality is at least two, but can be more when so indicated either explicitly or by context. Further, unless stated otherwise or otherwise clear from context, phrases such as based on means based at least in part on and not based solely on.

In at least one embodiment, even though the above discussion provides at least one embodiment having implementations of described techniques, other architectures may be used to implement described functionality, and are intended to be within scope of this disclosure. In addition, although specific responsibilities may be distributed to components and processes, they are defined above for purposes of discussion, and various functions and responsibilities might be distributed and divided in different ways, depending on circumstances.

In at least one embodiment, although subject matter has been described in language specific to structures and/or methods or processes, it is to be understood that subject matter claimed in appended claims is not limited to specific structures or methods described. Instead, specific structures or methods are disclosed as example forms of how a claim may be implemented.

From all the above, a person of ordinary skill would readily understand that the tool of the present disclosure provides numerous technical and commercial advantages, and can be used in a variety of applications. Various embodiments may be combined or modified based in part on the present disclosure, which is readily understood to support such combination and modifications to achieve the benefits described above.

What is claimed is:

1. A method to de-energize a wellhead annulus packoff that comprises at least one seal element, a seal lockdown energizing ring, a hanger lockdown energizing ring, a seal lockdown ring, a hanger lockdown ring, and one or more mechanical conditional operators, the one or more mechanical conditional operators being in a disengaged state with the wellhead annulus packoff in a fully energized stage, the method comprising:

enabling a first de-energizing force through the hanger lockdown energizing ring, the first de-energizing force to cause the hanger lockdown ring to be de-energized; and enabling a second de-energizing force, following the first de-energizing force and through the seal lockdown energizing ring, the second de-energizing force to cause the seal lockdown ring to be de-energized by catching an upper seal energizing ring within a narrow neck between fingers of the seal lockdown energizing ring to remove the upper seal energizing ring from being against the seal lockdown ring, which also causes the at least one seal element to be de-energized.

2. The method of claim 1, further comprising:

enabling, using first shoulders or surfaces, transfer of the second de-energizing force from the seal lockdown energizing ring to the upper seal energizing ring;

enabling, using second shoulders or surfaces, transfer of the second de-energizing force, from the upper seal energizing ring to the at least one seal element; and enabling, using third shoulders or surfaces, transfer of the second de-energizing force, from the seal element to a lower seal energizing ring so that the wellhead annulus packoff is de-energized.

3. The method of claim 1, further comprising:

continuing the first de-energizing force through the hanger lockdown energizing ring to cause the hanger lockdown energizing ring to be pulled up, wherein the hanger lockdown ring also releases to enable, in part, the hanger lockdown ring to be de-energized.

4. The method of claim 1, further comprising:

removing, based in part on the first de-energizing force, a radial support provided by the hanger lockdown energizing ring to the hanger lockdown ring to enable an inwards bias of the hanger lockdown ring, wherein the inwards bias is to retract away the hanger lockdown ring from a matching profile in a housing.

5. The method of claim 1, further comprising:

enabling the second de-energizing force as a single continuous de-energizing stroke or force that is applied to the seal lockdown energizing ring.

6. The method of claim 1, wherein the hanger lock down ring and the hanger lockdown energizing ring remain associated with the wellhead annulus packoff after the first de-energizing force, the method further comprising:

causing, by the second de-energizing force, a finger of the seal lockdown energizing ring to release from against the seal lockdown ring; and causing the seal lockdown ring to be also released.

7. The method of claim 1, further comprising:

removing radial support provided by at least a finger of the seal lockdown energizing ring to the seal lockdown ring, as consequence of the second de-energizing force, to cause an outwards bias of the seal lockdown ring, wherein the outwards bias enables the seal lockdown ring to retract away from a matching profile in a hanger.

8. The method of claim 1, further comprising:

allowing a flange of the upper seal energizing ring to catch within the narrow neck between the fingers of the seal lockdown energizing ring; and using the catch to transfer the second de-energizing force to the upper seal energizing ring, wherein the transfer enables the upper seal energizing ring to be pulled upwards for de-energizing the at least one seal element.

9. The method of claim 8, further comprising:

providing support to lift the seal lockdown ring out of an annular space between a housing and a hanger using a shoulder of the upper seal energizing ring.

10. The method of claim 1, further comprising:

removing the seal lockdown ring, under the second de-energizing force, to enable the seal lockdown ring to catch against a shoulder or surface of the at least one seal element, wherein a transfer mechanism engages the shoulder or surface of the at least one seal element, as part of the catch and after moving through a slot or space enabled by the one or more mechanical conditional operators.

11. A system for a wellhead annulus packoff, the system comprising:

at least one seal element, a seal lockdown energizing ring, a hanger lockdown energizing ring, a seal lockdown ring, a hanger lockdown ring, and one or more mechanical conditional operators, the one or more mechanical conditional operators being in a disengaged state with the wellhead annulus packoff in a fully energized stage, wherein the hanger lockdown energizing ring is adapted to receive therethrough a first de-energizing force to cause the hanger lockdown ring to be de-energized, and wherein the seal lockdown energizing ring is adapted to received therethrough a second de-energizing force that follows the first de-energizing force, the second de-energizing force to cause the seal lockdown ring to be de-energized by catching an upper seal energizing ring within a narrow neck between fingers of the seal lockdown energizing ring to remove the upper seal energizing ring from being against the seal lockdown ring, which also causes the at least one seal element to be de-energized.

12. The system of claim 11, further comprising:

a plurality of shoulders or surfaces in the system, wherein a first one of the plurality of shoulders or surfaces is to transfer the second de-energizing force from the seal lockdown energizing ring to the upper seal energizing ring, wherein a second one of the plurality of shoulders or surfaces is to transfer the second de-energizing force, from the upper seal energizing ring to the at least one seal element, and wherein a third one of the plurality of shoulders or surfaces is to transfer the second de-energizing force, from the seal element, to a lower seal energizing ring so that the wellhead annulus packoff is de-energized.

13. The system of claim 11, wherein the hanger lockdown energizing ring is further to receive therethrough a continuing of the first de-energizing force to cause the hanger lockdown energizing ring to be pulled up, wherein the hanger lockdown ring is to be released, and wherein the hanger lockdown ring is to enable, in part, the hanger lockdown ring to be de-energized.

14. The system of claim 11, wherein the hanger lockdown energizing ring is further to provide a radial support to the hanger lockdown ring, wherein the hanger lockdown ring is further to comprise an inwards bias, and wherein the hanger lockdown ring is further to retract away from a matching profile in a housing upon removal of the radial support and based in part on the first de-energizing force.

15. The system of claim 11, wherein the seal lockdown energizing ring is further to receive the second de-energizing force as a single continuous de-energizing stroke or force.

16. The system of claim 11, wherein the hanger lock down ring and the hanger lockdown energizing ring are further to remain associated with the wellhead annulus packoff after the first de-energizing force, and wherein the system further comprises:

a finger of the seal lockdown energizing ring to release from against the seal lockdown ring based in part on the second de-energizing force, wherein the seal lockdown ring to further to be released also based in part on the second de-energizing force.

17. The system of claim 11, further comprising:

at least a finger of the seal lockdown energizing ring to remove radial support to the seal lockdown ring as consequence of the second de-energizing force; and an outward bias of the seal lockdown ring to enable the seal lockdown ring to retract away from a matching profile in a hanger.

18. The system of claim 11, further comprising:

a flange of the upper seal energizing ring to catch within the narrow neck between the fingers of the seal lockdown energizing ring, wherein the catch is further to transfer the second de-energizing force to the upper seal energizing ring, and wherein the transfer enables the upper seal energizing ring to be pulled upwards for de-energizing the at least one seal element.

19. The system of claim 18, further comprising:

a shoulder of the upper seal energizing ring to provide support to lift the seal lockdown ring out of an annular space between a housing and a hanger.

20. The system of claim 11, further comprising:

a shoulder or surface of the at least one seal element to catch against the seal lockdown ring based in part on removal of the seal lockdown ring under the second de-energizing force;

a transfer mechanism to engage the shoulder or surface of the at least one seal element, as part of the catch; and a slot or space enabled by the one or more mechanical conditional operators to allow the transfer mechanism to move therethrough and to engage the shoulder or surface.

* * * * *